US009046100B2

(12) United States Patent
Watanabe et al.

(10) Patent No.: US 9,046,100 B2
(45) Date of Patent: Jun. 2, 2015

(54) VARIABLE VANE PUMP WITH COMMUNICATION GROOVE IN THE CAM RING

(71) Applicant: HITACHI AUTOMOTIVE SYSTEMS, LTD., Hitachinaka-shi, Ibaraki (JP)

(72) Inventors: Yasushi Watanabe, Kanagawa (JP); Koji Saga, Ebina (JP); Hideaki Ohnishi, Atsugi (JP)

(73) Assignee: HITACHI AUTOMOTIVE SYSTEMS, LTD., Hitachinaka-shi (JP)

( * ) Notice: Subject to any disclaimer, the term of this patent is extended or adjusted under 35 U.S.C. 154(b) by 0 days.

(21) Appl. No.: 14/478,443

(22) Filed: Sep. 5, 2014

(65) Prior Publication Data

US 2014/0377116 A1 Dec. 25, 2014

Related U.S. Application Data

(62) Division of application No. 13/011,972, filed on Jan. 24, 2011, now abandoned.

(30) Foreign Application Priority Data

Jan. 29, 2010 (JP) ..... 2010-018201

(51) Int. Cl.

| | |
|---|---|
| ***F04C 2/344*** | (2006.01) |
| ***F04C 14/22*** | (2006.01) |
| ***F04C 15/00*** | (2006.01) |
| ***F04C 15/06*** | (2006.01) |
| ***F01C 19/08*** | (2006.01) |

(52) U.S. Cl.

CPC ..... *F04C 2/3446* (2013.01); *F04C 14/22* (2013.01); *F04C 15/06* (2013.01); *F01C 19/08* (2013.01)

(58) Field of Classification Search

CPC ..... F04C 14/22; F04C 14/223; F04C 14/226; F04C 15/06

USPC ..... 418/16, 22, 24, 26, 27, 29, 30, 180

See application file for complete search history.

(56) References Cited

U.S. PATENT DOCUMENTS

| | | | |
|---|---|---|---|
| 2,318,292 | A | 5/1943 | Chandler |
| 3,456,593 | A | 7/1969 | Rosaen |
| 5,273,408 | A | 12/1993 | Yuge |

(Continued)

FOREIGN PATENT DOCUMENTS

| | | | |
|---|---|---|---|
| JP | 59-193203 | | 11/1984 |
| JP | 03003987 | A | 1/1991 |

(Continued)

*Primary Examiner* — Mary A Davis

(74) *Attorney, Agent, or Firm* — Foley & Lardner LLP

(57) ABSTRACT

A vane pump in which oil is drawn from at least one side, in an axial direction, of a cam ring and is discharged from at least the one side, in the axial direction, of the cam ring, the vane pump including: a portion defined by a groove formed on an inner circumference surface of the cam ring, the groove extending along a circumferential direction of the inner circumference surface and arranged in a position including a middle of an axial direction width on the inner circumference surface in an oil suction section or an oil discharge section of the cam ring, the groove being formed so that a depth of the groove is constantly shallower from a mid-point, in the circumferential direction, of the groove to both ends of the groove.

12 Claims, 14 Drawing Sheets

(56) References Cited

U.S. PATENT DOCUMENTS

| | | | |
|---|---|---|---|
| 5,484,271 | A | 1/1996 | Stich |
| 5,716,201 | A | 2/1998 | Peck et al. |
| 6,068,461 | A | 5/2000 | Haga et al. |
| 7,794,217 | B2 | 9/2010 | Williamson et al. |
| 2009/0101092 | A1 | 4/2009 | Ichinosawa et al. |

FOREIGN PATENT DOCUMENTS

| | | |
|---|---|---|
| JP | 2005-351117 | 12/2005 |
| JP | 2008-524500 | 7/2008 |
| JP | 2009-97424 | 5/2009 |
| WO | WO 2006/066405 A1 | 6/2006 |

VARIABLE VANE PUMP WITH COMMUNICATION GROOVE IN THE CAM RING

CROSS REFERENCE TO RELATED APPLICATION

This is a divisional of U.S. application Ser. No. 13/011,972, filed Jan. 24, 2011. This application relates to and claims priority from Japanese Patent Application No. 2010-018201, filed on Jan. 29, 2010. The entirety of the contents and subject matter of all of the above is incorporated herein by reference.

BACKGROUND OF THE INVENTION

The present invention relates to a vane pump which supplies oil to, for example, each sliding part in an internal combustion engine of a vehicle and a variable valve timing control apparatus that variably controls open/close timing of valves of the engine.

This kind of related art vane pump has been disclosed in Japanese Patent Provisional Publication to tokuhyou No. 2008-524500 (hereinafter is referred to as "JPA.sub.—2008524500") corresponding to International Publication No. WO2006/066405.

In this related art vane pump, an inlet port and an outlet port are each provided on both side walls of a housing where both end surfaces, in an axial direction, of a rotor and vanes make sliding contact with the both side walls, and the oil drawn from the inlet port to each pump chamber is pressurized and discharged to the outlet port.

SUMMARY OF THE INVENTION

In this related art vane pump, however, in a case where the pump rotates at high speed, difference in pressure in a suction section or a discharge section arises between both circumferential edge side portions, in an axial direction, of an inner circumference surface of a cam ring and a circumferential middle portion of the inner circumference surface of the cam ring. For this reason, there is a possibility that a stable pump operation cannot be achieved.

It is therefore an object of the present invention to provide a vane pump which is capable of achieving a stable action of the cam ring even when the pump rotates at high speed.

According to one aspect of the present invention, a vane pump in which oil is drawn from at least one side, in an axial direction, of a cam ring and is discharged from at least one side, in the axial direction, of the cam ring, the vane pump comprises: a portion defined by a groove formed on an inner circumference surface of the cam ring, the groove extending along a circumferential direction of the inner circumference surface and arranged in a position including a middle of an axial direction width on the inner circumference surface in an oil suction section or an oil discharge section of the cam ring.

According to another aspect of the present invention, a vane pump comprises: a rotor rotatably driven; a plurality of vanes arranged at an outer circumference of the rotor and extending/retracting in a radial direction; a cam ring housing, at an inner circumferential side thereof, the rotor and the vanes, the extending/retracting movement of the vanes occurring by the rotation of the rotor and sliding contact of each top end edge of the vanes with an inner circumference surface of the cam ring; a housing housing the cam ring inside the housing and defining a plurality of pump chambers by the housing, the vanes, the cam ring and the rotor; an inlet port provided at least one side of both side walls of the housing which respectively face axial direction both sides of the cam ring and opening to a section where the vanes extend; an outlet port provided at least one side of the both side walls of the housing which respectively face the axial direction both sides of the cam ring and opening to a section where the vanes retract; and a communication portion formed at a circumferential portion except both circumferential edge sides of an axial direction width on the inner circumference surface of the cam ring in the section where the vanes extend and connecting the pump chambers.

According to a further aspect of the invention, a vane pump comprises: a rotor rotatably driven and having, at an outer circumference thereof, a plurality of opening slots; a plurality of vanes provided in the respective slots; a cam ring housing, at an inner circumferential side thereof, the rotor and the vanes, extending/retracting movement of the vanes at the outer circumference of the rotor occurring by the rotation of the rotor; a housing housing the cam ring inside the housing and defining a plurality of pump chambers by the housing, the vanes, the cam ring and the rotor; an inlet port provided at least one side of both side walls of the housing which respectively face axial direction both sides of the cam ring and opening to a section where a volume of the pump chamber increases; an outlet port provided at least one side of the both side walls of the housing which respectively face the axial direction both sides of the cam ring and opening to a section where the volume of the pump chamber decreases; and a communication portion formed at a circumferential portion except both circumferential edge sides of an axial direction width on an inner circumference surface of the cam ring in the section where the volume of the pump chamber decreases and connecting the pump chambers.

According to the present invention, even when the pump rotates at high speed, the stable action of the cam ring can be achieved all the time.

The other objects and features of this invention will become understood from the following description with reference to the accompanying drawings.

DETAILED DESCRIPTION OF THE INVENTION

Figure 1:
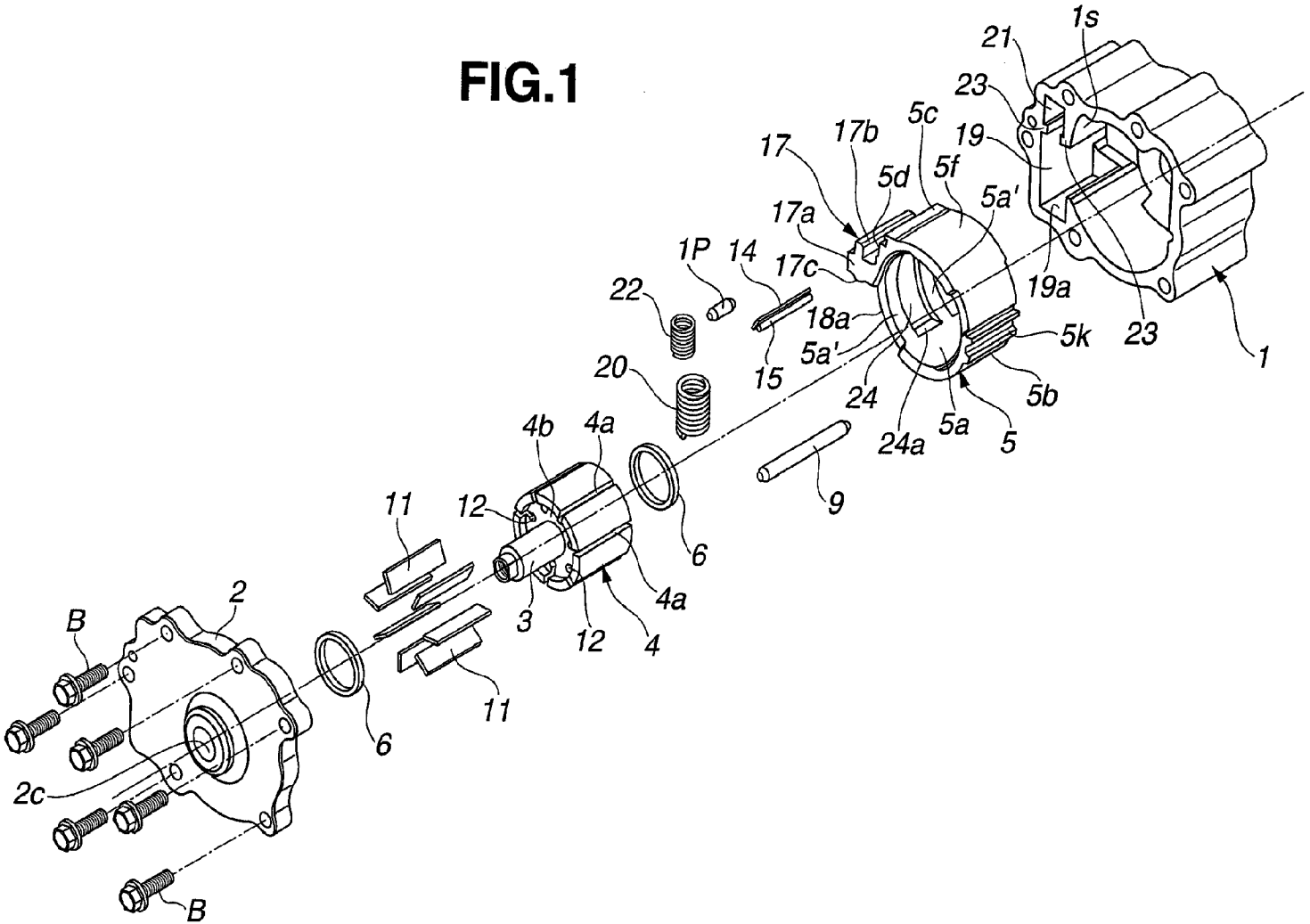
FIG. 1 is a perspective exploded view of a vane pump according to a first embodiment.

Embodiments of a vane pump of the present invention will be explained below with reference to the drawings. The embodiments show vane pumps applied to a variable displacement oil pump that supplies lubricating oil to each sliding part in an internal combustion engine of a vehicle.

First Embodiment

As shown in FIGS. 1 to 4, a vane pump is installed at a front end portion of a cylinder block of the engine. The vane pump has a pump housing 1 having a bottomed cylindrical shape, one end opening of which is covered with a cover 2, a driving shaft 3 which penetrates the pump housing 1 at a center of the pump housing 1 and is driven and rotated by an engine crankshaft, a rotor 4 which is rotatably housed inside the pump housing 1 and fixed to the driving shaft 3 at its center, a cam ring 5 which is a movable member and is rockably provided at an outer circumferential side of the rotor 4, and a pair of vane rings 6, 6 having a small diameter which are slidably arranged on both side surfaces at an inner circumferential side of the rotor 4.

Figure 5:
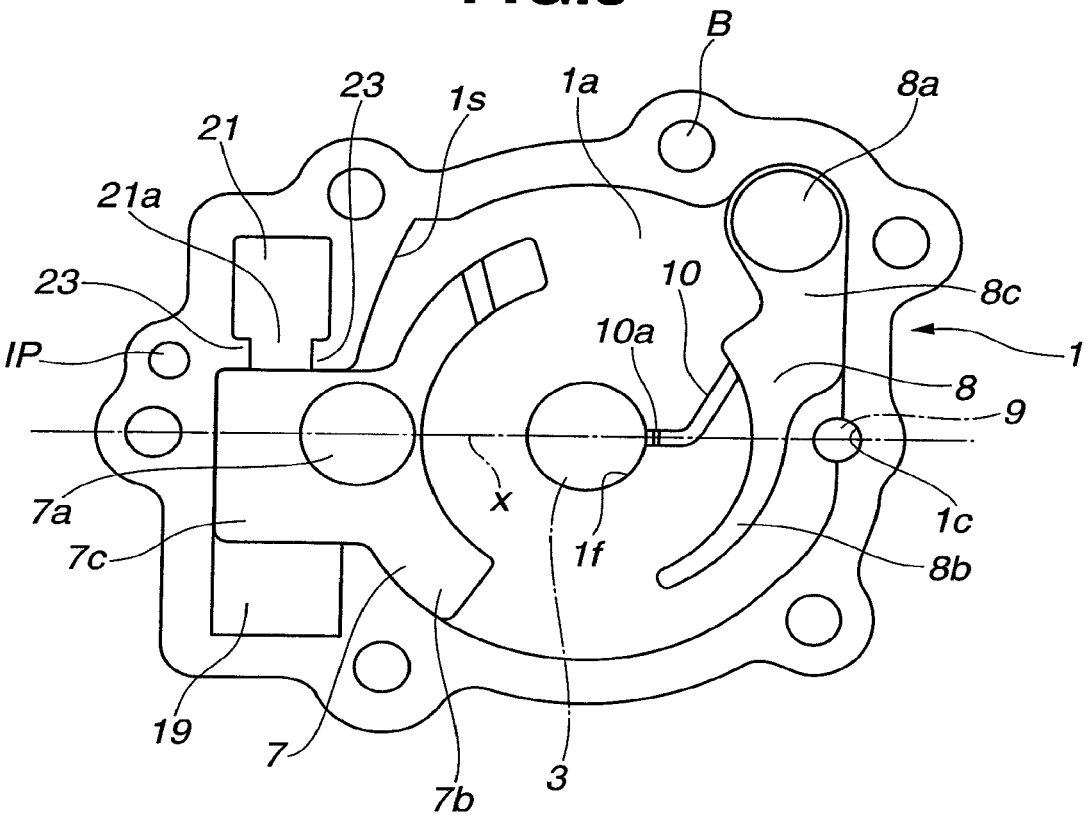
FIG. 5 is a front view of a pump housing.

The pump housing 1 is made of aluminum alloy material and is integrally formed. As shown in FIG. 5, since one side surface, in an axial direction, of the cam ring 5 makes sliding contact with a depressed or hollow bottom surface 1*a* of the pump housing 1, a sliding contact area of the bottom surface 1*a* is formed by machining with high accuracy of flatness and surface roughness.

The pump housing 1 is provided with, at a certain position on an inner circumference surface thereof, a hole into which one end portion of a pivot pin 9 is inserted and a pivot groove 1*c* having a semicircular shape in cross section. The pivot pin 9 serves as a pivot of the cam ring 5 for the rocking motion of the cam ring 5.

Figure 2:
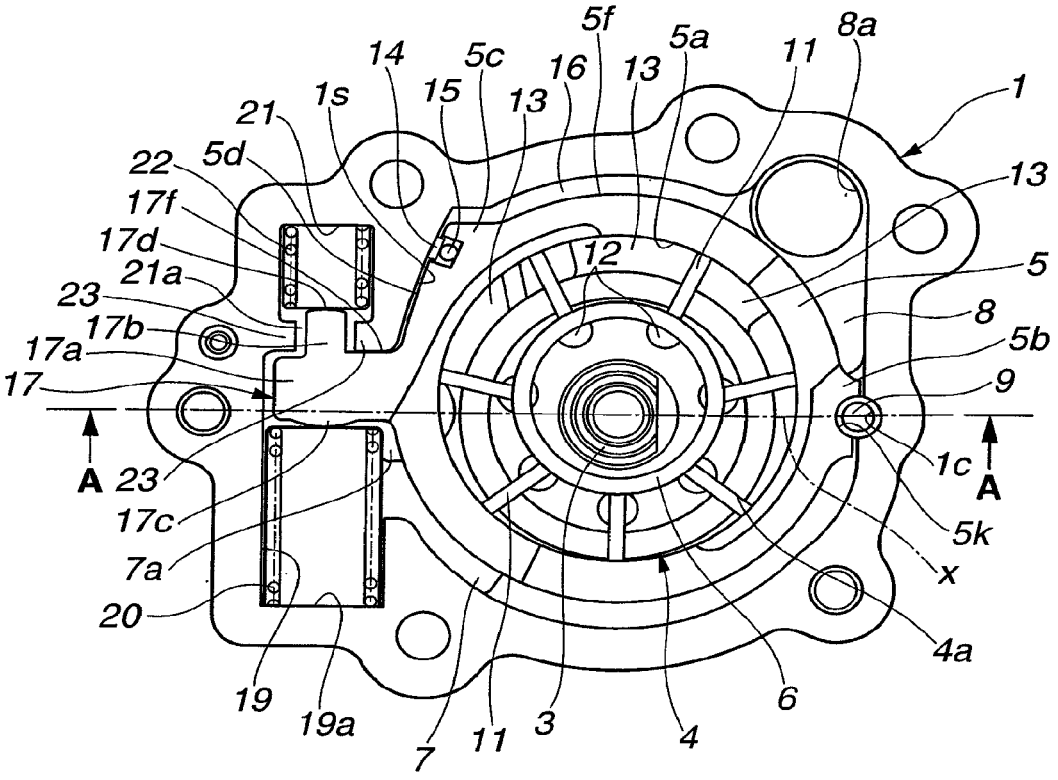
FIG. 2 is a front view of the vane pump with a pump cover removed.

In addition, as can be seen in FIGS. 2 and 5, a concave arc-shaped seal surface is provided at an upper side with respect to a line X (hereinafter called a cam ring reference line) connecting an axial center of the pivot pin 9 and a center of the pump housing 1 (a shaft center of the driving shaft 3) at the inner circumference of the pump housing 1. More specifically, the seal surface is positioned at an upper left side of the inner circumference of the pump housing 1, as shown in FIGS. 1 to 3 and 5.

The seal surface 1*s* seals one end of an upper end side of an after-mentioned control oil chamber 16 in cooperation with an after-mentioned sealing member 14 that is provided in the cam ring 5 with the sealing member 14 making sliding contact with the seal surface is. This seal surface is, as shown in FIG. 5, formed into an arc-shaped surface having a certain radius of R1.

Furthermore, as can be seen in FIG. 5, an inlet port 7 is provided at a left hand side of the driving shaft 3 on the bottom surface is of the pump housing 1, also an outlet port 8 is provided at a right hand side of the driving shaft 3 on the bottom surface 1*a*. These inlet and outlet ports 7 and 8 are arranged on substantially opposite sides of the driving shaft 3.

Figure 4:
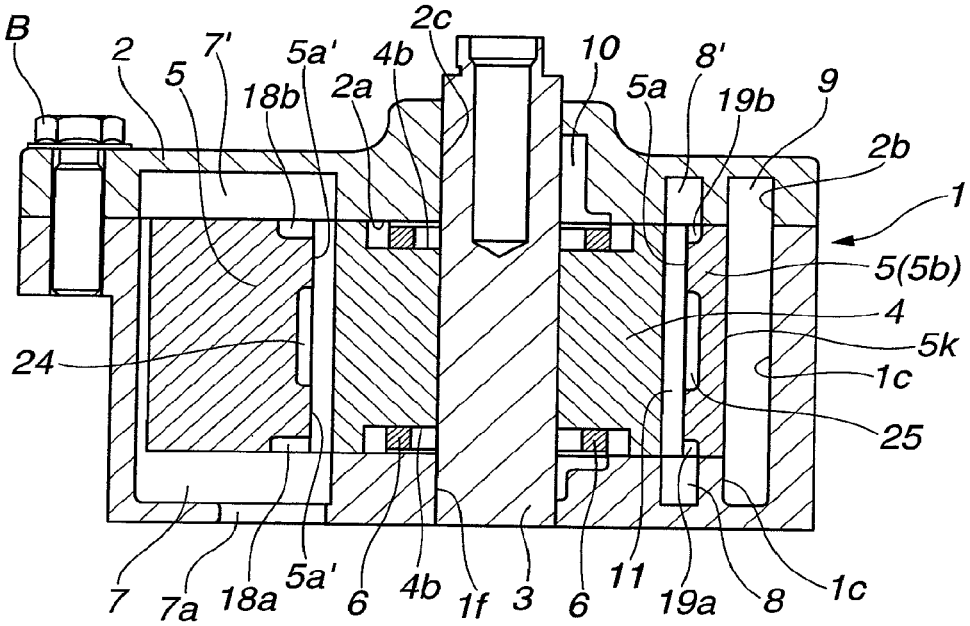
FIG. 4 is a longitudinal cross section taken along a plane A-A in FIG. 2.

As shown in FIGS. 4 and 5, the inlet port 7 communicates with an inlet opening 7*a* where the oil in an oil pan (not shown) is pumped up and flows in. On the other hand, the outlet port 8 communicates with an outlet opening 8*a*, then communicates with the each sliding part in the engine and e.g. a variable valve timing control apparatus that variably controls open/close timing of valves of the engine through an oil main gallery (not shown).

The inlet port 7 has an arc-shaped inner-side port section 7*b* and a substantially rectangular outer-side port section 7*c*. The outlet port 8 has an arc-shaped inner-side port section 8*b* and an outer-side port section 8*c* that directly communicates with the outlet opening 8*a*.

The bottom surface 1*a* of the pump housing 1 is provided with, at the substantially center thereof, a shaft bearing bore if for supporting the driving shaft 3. This shaft bearing bore if is supplied with the oil that is discharged from the outlet port 8 via a depressed groove tip 10*a* of a substantially L-shaped narrow oil supply groove 10. Further, the oil supply groove 10 is configured so that the oil is supplied to both side surfaces of the rotor 4 and a side surface of each vane 11 (described later) from an opening of the oil supply groove 10 for securing lubrication of these sliding parts.

The cover 2 is formed into a thick plate shape, as shown in FIGS. 1 and 4. The cover 2 is provided with, on a substantially flat inner side surface 2*a* thereof, an inlet port 7' and an outlet port 8' respectively communicating with the inlet port 7 and the outlet port 8, same as the bottom surface 1*a* of the pump housing 1. Further, the cover 2 is provided with, at an edge of the inner side surface 2*a*, a pin hole 2*b* into which the other end portion of the pivot pin 9 is inserted. In addition, a shaft insertion hole 2*c* into which the driving shaft 3 is inserted is formed at a substantially center of the cover 2 for rotatably supporting the driving shaft 3.

As shown in FIG. 1, the cover 2 is fixed to the pump housing 1 with a plurality of bolts B with its positioning in a circumferential direction made by a plurality of positioning pins IP.

The driving shaft 3 rotates the rotor 4 in a clockwise direction in FIG. 2 by a turning force transmitted from the engine crankshaft. In FIG. 2 and other drawings, a left half of the driving shaft 3 is a suction section, while a right half of the driving shaft 3 is a discharge section.

Figure 3:
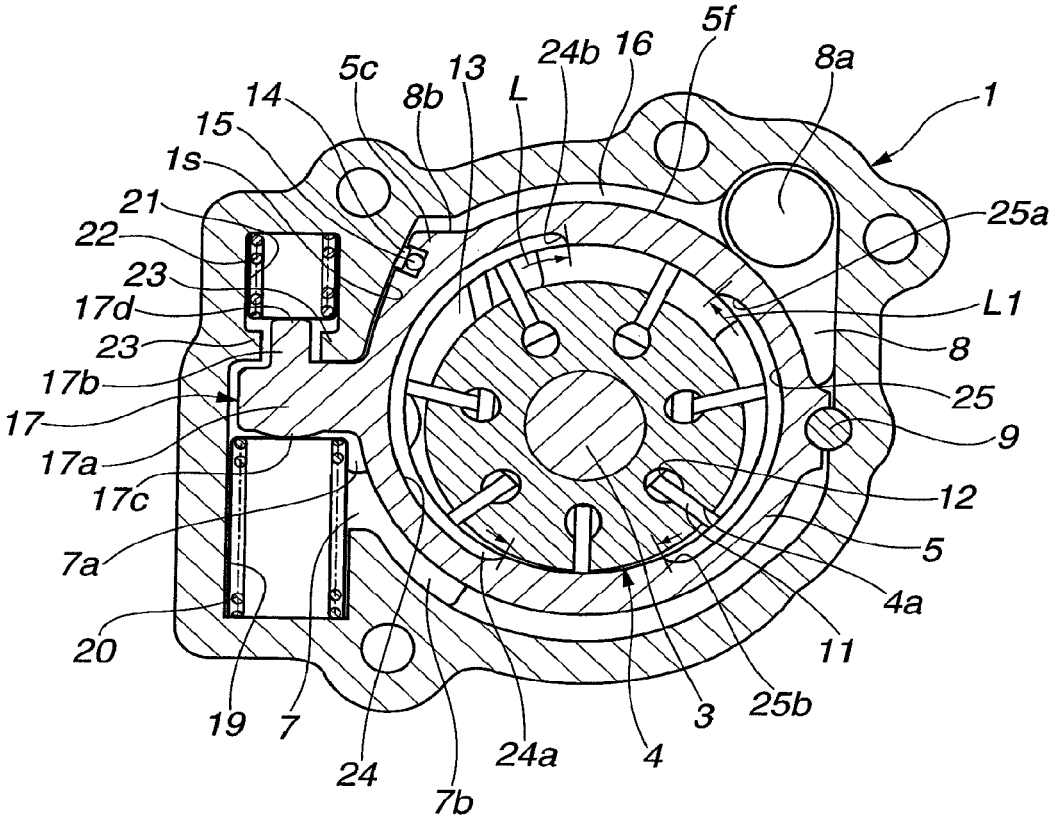
FIG. 3 is a sectional view of the vane pump.

The rotor 4 has seven slits (slots) 4*a* formed in a radially outward direction from the center side of the rotor 4, as shown in FIGS. 1 to 3. The vanes 11 are each provided in the slits 4*a*, and are supported in the slits 4*a* so that the vane 11 can move or extend/retract in the radial direction. Further, a back-pressure chamber 12 is formed at each base end portion of the slit 4*a*. This back-pressure chamber 12 has a substantially circular shape in cross section and hydraulic pressure (pressurized fluid or oil) discharged to the outlet port 8 is introduced into the back-pressure chamber 12 to force the vane 11 outwards in the radial direction by the pressurized fluid.

Furthermore, the rotor 4 is provided with annular depressed grooves or hollows 4*b*, 4*b* at the both side surfaces, in the axial direction, of the inner circumferential side of the rotor 4, The depressed hollows 4*b*, 4*b* support the vane rings 6, 6 so that the vane rings 6, 6 eccentrically rotate at the inner circumferential side of the rotor 4.

As shown in FIG. 2, each inner side base end edge of the vane 11 makes sliding contact with an outer circumference surfaces of the pair of vane rings 6, 6, while each top end edge of the vane 11 makes sliding contact with an inner circumference surface 5*a* of the cam ring 5.

A plurality of sector-shaped pump chambers 13, each of which is a working chamber, are defined by the adjacent vanes 11, the inner circumference surface 5*a* of the cam ring 5, an outer circumference surface of the rotor 4, the bottom surface 1*a* of the pump housing 1 and the inner side surface 2*a* of the cover 2, and liquid-tightness of each pump chamber 13 is ensured by these parts and members.

Each vane ring 6 is set so as to push out each vane 11 in the radially outward direction.

The cam ring 5 is made of sintered metal which is readily formable and is integrally formed into a substantially cylindrical shape. In FIG. 2, a pivot protrusion 5*b* is provided at an outer circumference surface of the cam ring 5 on an upper right side of the cam ring reference line X. Further, a supporting groove 5*k* having a semicircular shape in cross section is formed along an axial direction of the cam ring 5 at a center on an outer side surface of the pivot protrusion 5*b*. The supporting groove 5*k* supports the pivot pin 9 in cooperation with the pivot groove 1*c*, namely that the pivot pin 9 is inserted and fitted into a supporting hole formed by the supporting groove 5*k* and the pivot groove 1*c*. The supporting groove 5*k* (or the pivot pin 9) serves as an eccentric-rocking or moving fulcrum.

The cam ring 5 is provided with, at an upper position of the cam ring reference line X, i.e. at an upper left side position in FIG. 2, a substantially inverted U-shaped boss portion 5*c* formed integrally with the cam ring 5. On an outer surface of the boss portion 5*c*, a convex arc-shaped surface (an arc surface) 5*d* making sliding contact with the concave arc-shaped seal surface 1*s* is formed.

Figure 6:
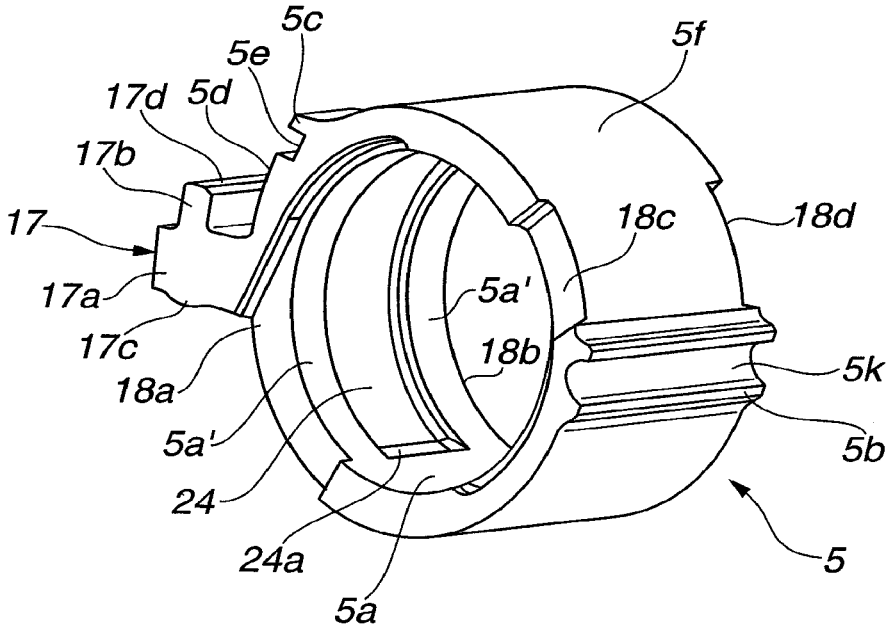
FIG. 6 is a perspective view, viewed from one side, of a cam ring.
Figure 7:
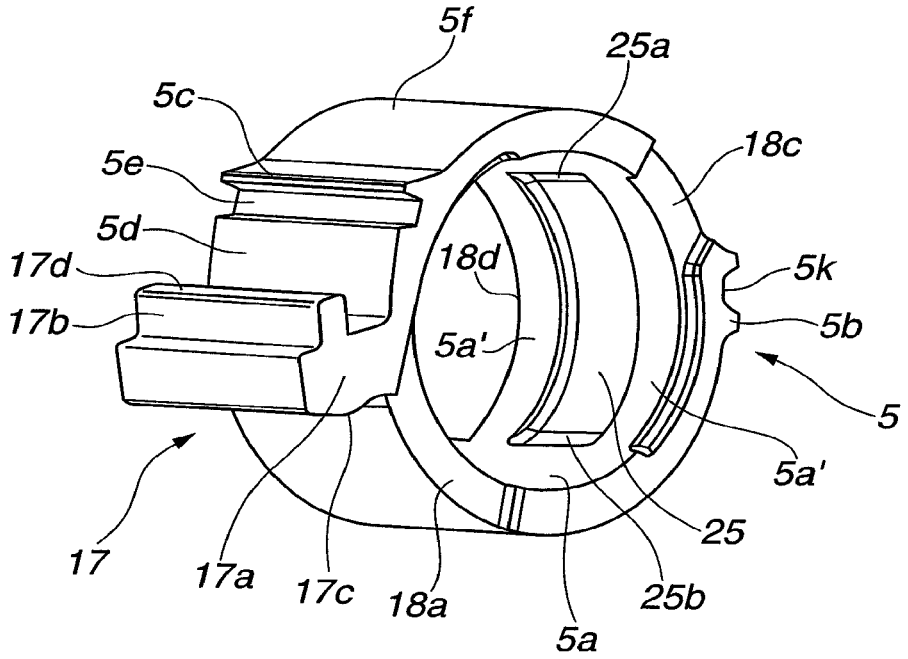
FIG. 7 is a perspective view, viewed from the other side, of the cam ring.

As shown in FIGS. 6 and 7, a holding groove 5*e* having a rectangular shape in longitudinal cross section is formed on the arc surface 5*d*. As mentioned above, the sealing member 14 sealing one end side of the control oil chamber 16 is fitted into and fixed to the holding groove 5*e*. On the other hand, the other end side of the control oil chamber 16 is sealed by the supporting groove 5*k* of the pivot protrusion 5*b* of the cam ring 5 and the pivot pin 9.

Here, with regard to the arc surface 5*d*, a radius of curvature of the arc surface 5*d* is set to the almost same radius of curvature as the seal surface 1*s* so as to form a constant minute or slight gap between the arc surface 5*d* and the seal surface 1*s*.

The sealing member 14 is made of, for example, synthetic resin having low friction, and formed into a long narrow shape along the axial direction of the cam ring 5. The sealing member 14 is set so as to be pressed against the seal surface 1*s* by an elastic force of an elastic member 15 (made of, i.e. rubber) which is secured to a bottom side of the holding groove 5*e*. With this sealing structure, good liquid-tightness of the control oil chamber 16 can be ensured all the time.

The cam ring 5 is provided with, on axial direction both end surfaces thereof on the inlet port 7 side, a pair of inlet side cut grooves 18*a*, 18*b* by which the oil (fluid) flows into each pump chamber 13 in the suction section, as shown in FIGS. 4, 6 and 7. Likewise, the cam ring 5 is provided with, on axial direction both end surfaces thereof on the outlet port 8 side, a pair of outlet side cut grooves 18*c*, 18*d* by which the oil (fluid) in each pump chamber 13 flows out to the outlet port 8 in the discharge section. As can be seen in the drawings, these inlet and outlet side cut grooves 18*a*.about.18*d* are arranged along a circumferential direction of the cam ring 5.

The control oil chamber 16 is defined between the outer circumference surface of the cam ring 5, the pivot protrusion 5*b* and the sealing member 14, and takes on a substantially arc shape. The control oil chamber 16 is configured so as to move or rock the cam ring 5 in a counterclockwise direction in FIG. 2 with the pivot pin 9 being the fulcrum when the discharged hydraulic pressure (pressurized fluid or oil) introduced into the control oil chamber 16 from the outlet port 8 acts on a pressure-receiving surface 5*f* of the cam ring outer circumference surface then so as to decrease an eccentric amount of the cam ring 5 with respect to the rotor 4.

The cam ring 5 is provided with an arm 17 that is an extending part protruding radially outwards. The arm 17 is formed integrally with the cam ring 5, and is placed on the opposite side to the pivot protrusion 5*b* formed at the outer circumference surface of the cylindrical body of the cam ring 5. The arm 17 has, as shown in FIGS. 1 to 3, 6 and 7, a rectangular plate-shaped arm body 17*a* radially extending from the cylindrical body of the cam ring 5 and a protruding portion 17*b* formed integrally with an upper surface, at a top end side, of the arm body 17*a*.

The arm body 17*a* is provided with, at a lower surface thereof which is opposite side to the protruding portion 17*b*, a convex portion 17*c* that is formed integrally with the arm body 17*a* and has a rounded surface. The protruding portion 17*b* protrudes in a direction substantially perpendicular to the arm body 17*a*, and is provided with an upper surface 17*d* having a rounded surface whose radius of curvature is small.

As can be seen in FIGS. 1 to 3 and 5, a lower side first spring holder 19 and an upper side second spring holder 21 are concentrically formed in the pump housing 1 at a position opposite to the pivot groove 1*c*, i.e. at upper and lower positions of the arm 17.

The first spring holder 19 has a substantially rectangular shape and extends along an axial direction of the pump housing 1. On the other hand, although the second spring holder 21 is set to be shorter than that of the first spring holder 19, the second spring holder 21 has a substantially rectangular shape and extends along the axial direction of the pump housing 1, same as the first spring holder 19.

As shown in FIG. 5, the second spring holder 21 has a pair of stopper portions 23, 23 having a long rectangular plate shape. The stopper portions 23, 23 are formed integrally with the second spring holder 21, and extend inwards from a width direction of a lower end opening part 21*a* so as to face each other. Further, the stopper portions 23, 23 are formed so that the protruding portion 17*b* of the arm 17 can be inserted into and come out of the second spring holder 21 through the opening part 21*a* between both stopper portions 23, 23. More specifically, both stopper portions 23, 23 are formed so as to limit or restrict a maximum extension deformation of an after-mentioned second coil spring 22.

A first coil spring 20 that is a forcing member is set inside the first spring holder 19. The first coil spring 20 forces the cam ring 5 in the clockwise direction in FIG. 2 through the arm 17. That is to say, the first coil spring 20 forces the cam ring 5 in a direction in which the eccentric amount of a center of the inner circumference surface of the cam ring 5 with respect to a rotation center of the rotor 4 becomes large.

The first coil spring 20 has a predetermined spring-load W3. A lower end of the first coil spring 20 is elastically connected to a bottom surface 19*a* of the first spring holder 19, while an upper end of the first coil spring 20 is in contact with the rounded surface convex portion 17*c* formed on the lower surface of the arm body 17*a* all the time. The cam ring 5 is then forced in the direction in which the eccentric amount of the center of the inner circumference surface of the cam ring 5 with respect to the rotation center of the rotor 4 becomes large, i.e. in the clockwise direction in FIG. 2, by the first coil spring 20.

On the other hand, the second coil spring 22 that is a forcing member is set inside the second spring holder 21. The second coil spring 22 forces the cam ring 5 in the counterclockwise direction in FIG. 2 through the arm 17.

An upper end of the second coil spring 22 is elastically connected to an upper wall surface 21*b* of the second spring holder 21. A lower end of the second coil spring 22 is elastically connected to the protruding portion 17*b* of the arm 17 from a maximum eccentric moving position, in the clockwise direction, of the arm 17 of the cam ring 5 until the lower end of the second coil spring 22 is stopped by both the stopper portions 23, 23, then provides an urging force in the counterclockwise direction to the cam ring 5.

Although the second coil spring 22 has a predetermined spring-load against the first coil spring 20, this spring-load is set to be smaller than the spring-load W3 of the first coil spring 20. That is, by a load difference W1 in the spring-load between the first coil spring 20 and the second coil spring 22, the cam ring 5 is set to an initial position (the maximum eccentric position).

More specifically, the cam ring 5 is forced all the time in a direction in which the cam ring 5 eccentrically moves upwards, i.e. in a direction in which a volume of the pump chamber 13 becomes large, by the first coil spring 20 and the second coil spring 22 with the spring-load W1 provided to the arm 17.

The spring-load W1 is a load by which the cam ring 5 starts to move when the hydraulic pressure becomes a required hydraulic pressure P1 for the variable valve timing control apparatus or more.

Figure 13:
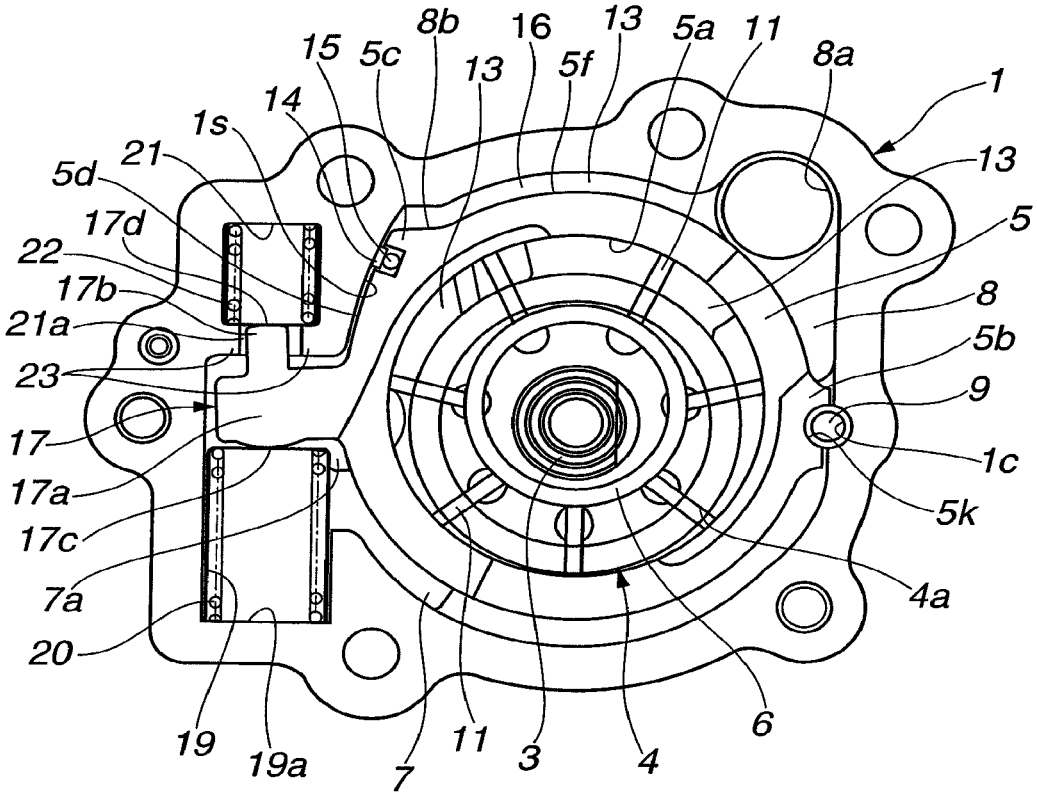
FIG. 13 is a drawing for explaining a cam ring action.

As described above, the second coil spring 22 is in contact with the arm 17 when the eccentric amount of the center of the inner circumference surface of the cam ring 5 with respect to the rotation center of the rotor 4 is a predetermined value or more. However, as shown in FIG. 13, when the eccentric amount of the cam ring 5 with respect to the rotor 4 is less than the predetermined value, the lower end of the second coil spring 22 is stopped by both the stopper portions 23, 23 with a compression state of the second coil spring 22 being held, then the second coil spring 22 is in almost no contact with the arm 17.

Here, a spring-load W2 of the first coil spring 20 when the second coil spring 22 is stopped by both the stopper portions 23, 23 and the load acting on the arm 17 becomes zero is a load by which the cam ring 5 starts to move when hydraulic pressure becomes a required hydraulic pressure P2 for a piston oil jet etc. or a required hydraulic pressure P3 at a maximum rotation of the engine crankshaft.

Figure 8:
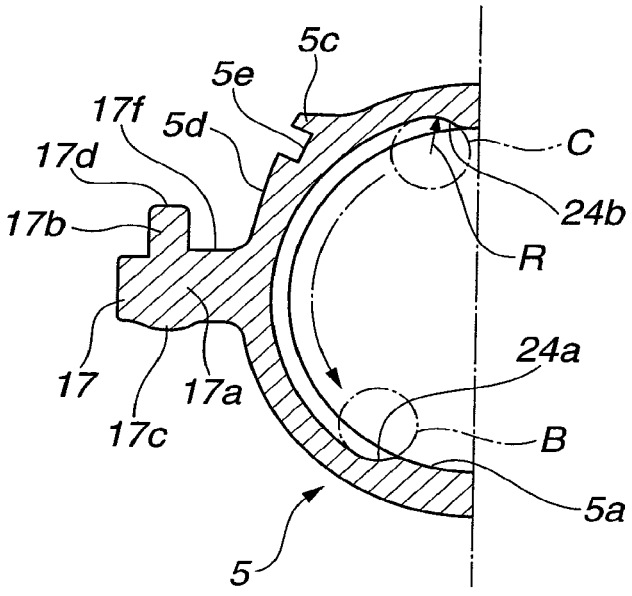
FIG. 8 is a sectional view of the cam ring, showing a main part of the cam ring.

As shown in FIGS. 2 and 8, a root portion upper surface 17*f* is formed between the arm body 17*a* and the cylindrical body of the cam ring 5. When the cam ring 5 rotates in the clockwise direction by the spring force of the first coil spring 20, the root portion upper surface 17*f* makes contact with a lower surface of the one stopper portion 23, the further rotation, in the clockwise direction, of the cam ring 5 is then limited. That is, the moving or rocking position of the cam ring 5 is limited or set to the initial set position (the maximum eccentric position) by the spring force of the first coil spring 20.

As shown in FIGS. 3, 6 and 7, the cam ring 5 is provided with, on the inner circumference surface 5*a* thereof, an inlet side communication groove 24 and an outlet side communication groove 25 respectively in the suction section (in which each vane 11 extends) where the arc-shaped inner-side port section 7*b* of the inlet port 7 is formed and in the discharge section (in which each vane 11 retracts) where the arc-shaped inner-side port section 8*b* of the outlet port 8 is formed. These inlet and outlet side communication grooves 24 and 25 are communication portions.

Both the inlet and outlet side communication grooves 24 and 25 are formed parallel to the inlet side cut grooves 18*a*, 18*b* and the outlet side cut grooves 18*c*, 18*d* respectively. More specifically, each of the inlet and outlet side communication grooves 24 and 25 is formed into a band shape, and extends along the circumferential direction of the inner circumference surface 5*a* at a circumferential middle portion except both circumferential edge side portions 5*a*', 5*a*', in the axial direction, of the inner circumference surface 5*a*. Lengths L and L1 (see FIG. 3) of the inlet and outlet side communication grooves 24 and 25 are respectively set to almost the same arc lengths as the inner-side port sections 7*b* and 8*b*. Axial direction widths of the both circumferential edge side portions 5*a*', 5*a*' of the inner circumference surface 5*a* are set to be almost the same as each other. With this structure, the adjacent pump chambers 13 communicate with each other.

Further, as can be seen in FIGS. 3 and 8 to 12, each depth d of the inlet and outlet side communication grooves 24 and 25 is set to approximately ⅓ (one third) of a thickness of the cam ring 5.

In addition, starting-point portions 24*a*, 25*a* and endpoint portions 24*b*, 25*b* of the inlet and outlet side communication grooves 24 and 25 are set so that their depths are gradually shallower from the middle of the inlet and outlet side communication grooves 24 and 25. That is, as seen in FIGS. 9, 10 and 11, 12 which are enlarged views of circles B and C in FIG. 8 and enlarged views of the discharge side, each of the starting-point portions and the endpoint portions 24*a*, 24*b* and 25*a*, 25*b* is formed into an arc-shaped surface having a relatively small radius R, then gradually becomes shallower from the middle of the inlet and outlet side communication grooves 24 and 25.

In the following description, basic operation or working of the present embodiment will be explained. Before the explanation, a relationship between a control hydraulic pressure by the related art variable displacement vane pump employing inner/outer double coil springs and a required hydraulic pressure for the sliding parts in the engine or the variable valve timing control apparatus or a piston cooling device will be explained with reference to FIG. 16.

With respect to the hydraulic pressure required for the internal combustion engine, in the case where the variable valve timing control apparatus is employed for the improved fuel economy and the exhaust emission control, as an actuating source of this apparatus, the hydraulic pressure of the oil pump is used. Thus, in order to improve actuation (operation) response of the apparatus, as shown by a broken line b in FIG. 16, as an actuating hydraulic pressure, a high hydraulic pressure P1 is required from an early stage where an engine rpm is low.

Further, in the case where the oil jet device for the piston cooling is employed, a high hydraulic pressure P2 is required at a middle rpm of the engine. A required hydraulic pressure at the maximum rpm of the engine is determined mainly by a hydraulic pressure P3 required for the lubrication of a bearing portion of the engine crankshaft. Therefore, the hydraulic pressure required for the whole internal combustion engine is shown by a characteristic of the broken line connecting lines b and c.

Here, regarding the middle rpm range required hydraulic pressure P2 and the high rpm range required hydraulic pressure P3 for the internal combustion engine, its relationship is generally P2<.P3. Also in many cases, both P2 and P3 are close values. Thus, in a range D from the middle rpm to the high rpm in FIG. 16, it is desirable to set the hydraulic pressure so that the hydraulic pressure does not increase even though the rpm increases.

Figure 16:
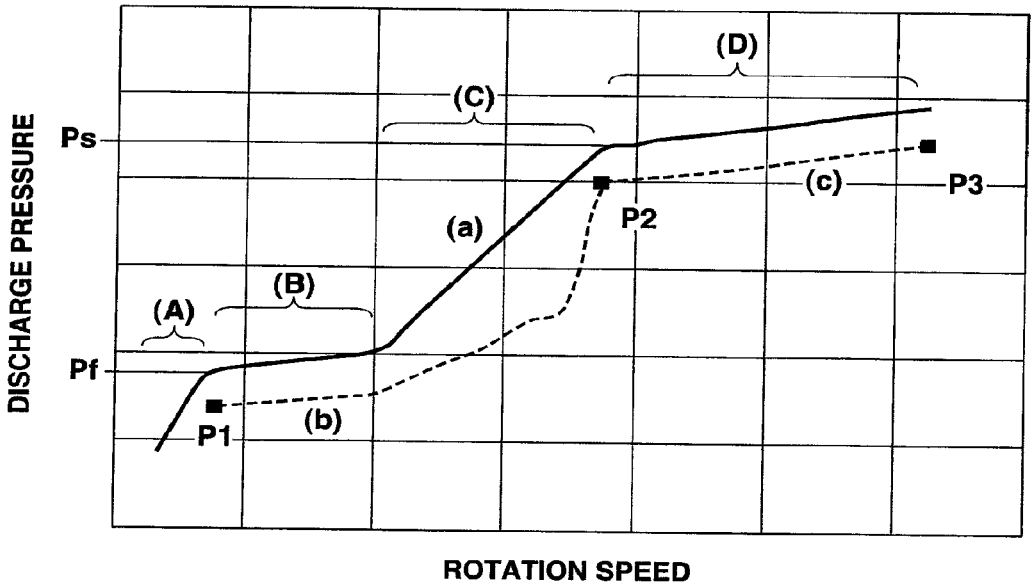
FIG. 16 is a characteristic showing a relationship between an engine rpm and a discharge pressure in a related art vane pump.

In the present embodiment, as shown by a solid line in FIG. 16, in a range from an engine start to the low rpm including engine idling, since a pump discharge pressure does not reach P1, the cam ring 5 is in a non-operative state (operation halt state) with the arm body 17*a* of the arm 17 of the cam ring 5 making contact with the one stopper portion 23 of the pump housing 1 by the difference in the spring-load between the first coil spring 20 and the second coil spring 22 (see FIG. 2).

At this time, the eccentric amount of the cam ring 5 is the maximum and a pump capacity becomes the maximum, then the discharge pressure quickly or rapidly rises with increase in the engine rpm as shown by a characteristic of A on the solid line in FIG. 16.

Subsequently, when the pump discharge pressure further increases with the further increase in the engine rpm and reaches Pf, the introduction hydraulic pressure in the control oil chamber 16 increases. The cam ring 5 then starts pressing down or compressing the first coil spring 20 that acts on the arm 17, and eccentrically moves or rocks in the counterclockwise direction with the pivot pin 9 being the fulcrum. Pf is a first cam actuation or operation pressure, and this Pf is set to be greater than the required hydraulic pressure P1 for the variable valve timing control apparatus.

With this cam ring action, the pump capacity decreases, and as shown by a characteristic of a range B, increase of the discharge pressure becomes small or gentle. Then as shown in FIG. 13, the second coil spring 22 is stopped by both the stopper portions 23, 23 with the compression state of the second coil spring 22 being held, and the cam ring 5 moves in the counterclockwise direction with the upper surface 17*d* of the protruding portion 17*b* provided with no load of the second coil spring 22.

In this state shown in FIG. 13, the load of the second coil spring 22 does not act on the cam ring 5 from this point, and the cam ring 5 is brought in a holding state in which the cam ring 5 does not move until the discharge pressure reaches P2 (hydraulic pressure P2 in the control oil chamber 16) and exceeds the spring-load W2 of the first coil spring 20. As a consequence, the discharge pressure increases with the increase in the engine rpm as shown by a characteristic of C. However, since the eccentric amount of the cam ring 5 becomes small and the pump capacity decreases, this increase of the range C does not show the rapidly rising characteristic like the range A.

Figure 14:
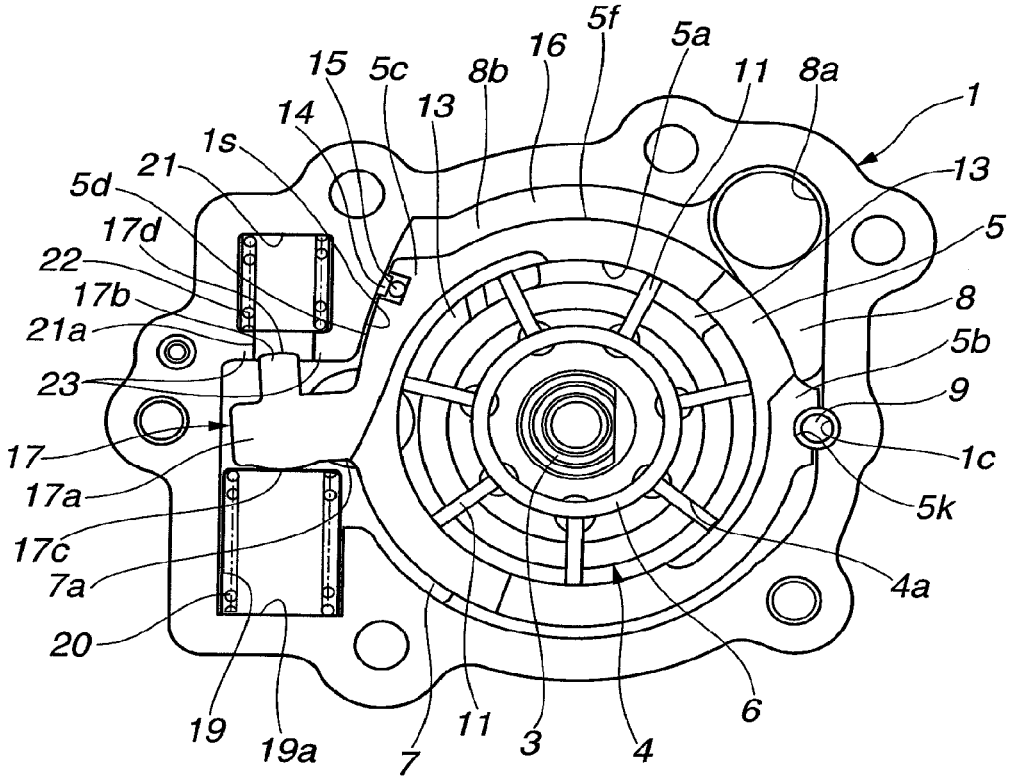
FIG. 14 is a drawing for explaining a cam ring action.

Further, when the engine rpm increases and the discharge pressure becomes Ps (P2) or higher, as shown in FIG. 14, the cam ring 5 moves in the counterclockwise direction while compressing the first coil spring 20 against the spring force of the spring-load W2 of the first coil spring 20 through the arm 17. With this moving action of the cam ring 5, the pump capacity further decreases and the increase in the discharge pressure becomes small or gentle, and the engine rpm reaches the maximum rpm while keeping a discharge pressure characteristic shown by D.

Consequently, since it is possible to adequately bring the discharge pressure (the solid line) at the pump high rotation speed to the required hydraulic pressure (the broken line), loss of power can be effectively suppressed.

Figure 15:
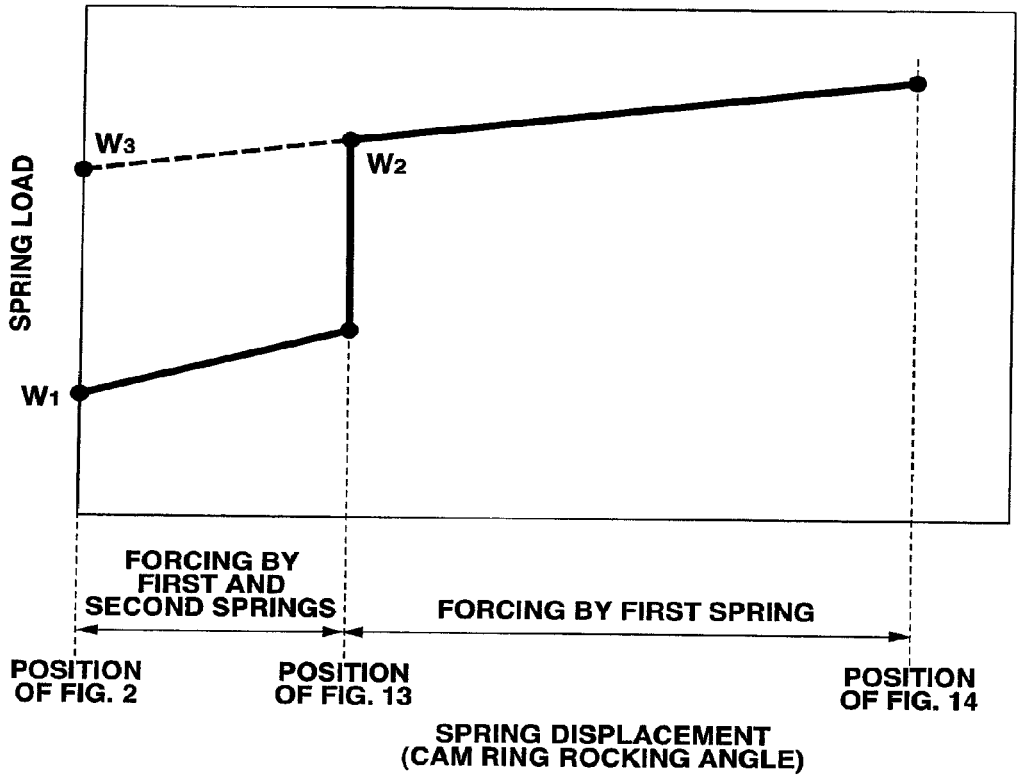
FIG. 15 is spring displacement-spring load characteristics of first and second coil springs.

FIG. 15 shows a relationship between spring displacement of each of the first and second coil springs 20, 22 or a rocking (or moving) angle of the cam ring 5 and the spring-loads W1, W2. In the early stage from the engine start to the low engine rpm, since the spring-load W1 obtained by subtracting the set load of the second coil spring 22 from the set load W3 of the first coil spring 20 is provided to the cam ring 5, the cam ring 5 can not move until the discharge pressure exceeds the spring-load W1.

When the discharge pressure exceeds the spring-load W1, the first coil spring 20 is compressed then its load increases. The second coil spring 22, meanwhile, gets closer to free length and its load decreases. As a result, the spring-load increases. This inclination is a spring constant.

At a position, shown in FIG. 13, of the cam ring 5, the spring-load is the spring-load W2 of the first coil spring 20, and it discontinuously changes (increases). However, when the discharge pressure exceeds the spring-load W2, although the first coil spring 20 is compressed then its load increases, since the number of the coil springs acting on the cam ring 5 is changed from two (the both coil springs 20, 22) to one (the first coil spring 20), the inclination is changed, namely that the spring constant decreases.

As explained above, although when the engine rpm increases and the discharge pressure reaches P1, the cam ring 5 starts moving then suppresses the increase in the discharge pressure, when a moving amount of the cam ring 5 reaches a predetermined moving amount in the counterclockwise direction shown in FIG. 13, no spring force of the second coil spring 22 is generated and the spring constant becomes small, while the spring-load W2 of the first coil spring 20 discontinuously increases. Therefore, after the discharge pressure increases to P2, the moving action of the cam ring 5 starts again (see FIG. 14). That is, since the relative spring-load of the first and second coil springs 20, 22 acts on the cam ring 5 and the spring load shows a nonlinear spring characteristic, the cam ring 5 has specific or unique moving (rocking) characteristic.

In this manner, by the nonlinear spring characteristic of the spring forces of the both coil springs 20, 22, the discharge pressure has the characteristic shown by the ranges A.about.D in FIG. 16, and it is possible to adequately bring the control hydraulic pressure (the solid line) to the required hydraulic pressure (the broken line). As a result, loss of power caused by unnecessary increase of the hydraulic pressure can be sufficiently reduced.

Further, since the two springs of the first and second coil springs 20, 22 facing each other are employed, each spring-load of the coil springs 20, 22 can be arbitrarily set according to the change of the discharge pressure. It is therefore possible to set an optimum spring force for the discharge pressure.

The arm 17 does not make contact with the upper end of the first coil spring 20 and the lower end of the second coil spring 22 through plunger etc., but directly makes contact with these upper end and lower end and compresses them. Thus this structure is simple and increase in parts count can be suppressed. This facilitates assembly and leads to cost reduction.

In addition, since the convex portion 17*c* of the arm body 17*a* of the arm 17 and the upper surface 17*d* of the protruding portion 17*b* are formed into the arc-shaped rounded surface, change of their contact angles or contact points with the upper and lower ends of the first and second coil springs 20, 22 can be small. With this, displacement of the first coil spring 20 and the lower end of the second coil spring 22 can be stable.

Moreover, in the present embodiment, the lubricating oil discharged from the outlet opening 8*a* through the outlet port 8 is used not only for the lubrication of the sliding parts in the engine, but used as the actuating source of the variable valve timing control apparatus. As described above and shown in FIG. 16, since the good rising (range A) of the discharge pressure can be achieved at the early stage, operation response of a relative rotational phase control between a timing sprocket and a camshaft, by which the rotational phase is advanced or retarded, can be improved even just after the engine start.

In the present embodiment, by providing the inlet side communication groove 24 and the outlet side communication groove 25 on the inner circumference surface 5*a* of the cam ring 5, the following operation and effect are obtained.

Figure 17:
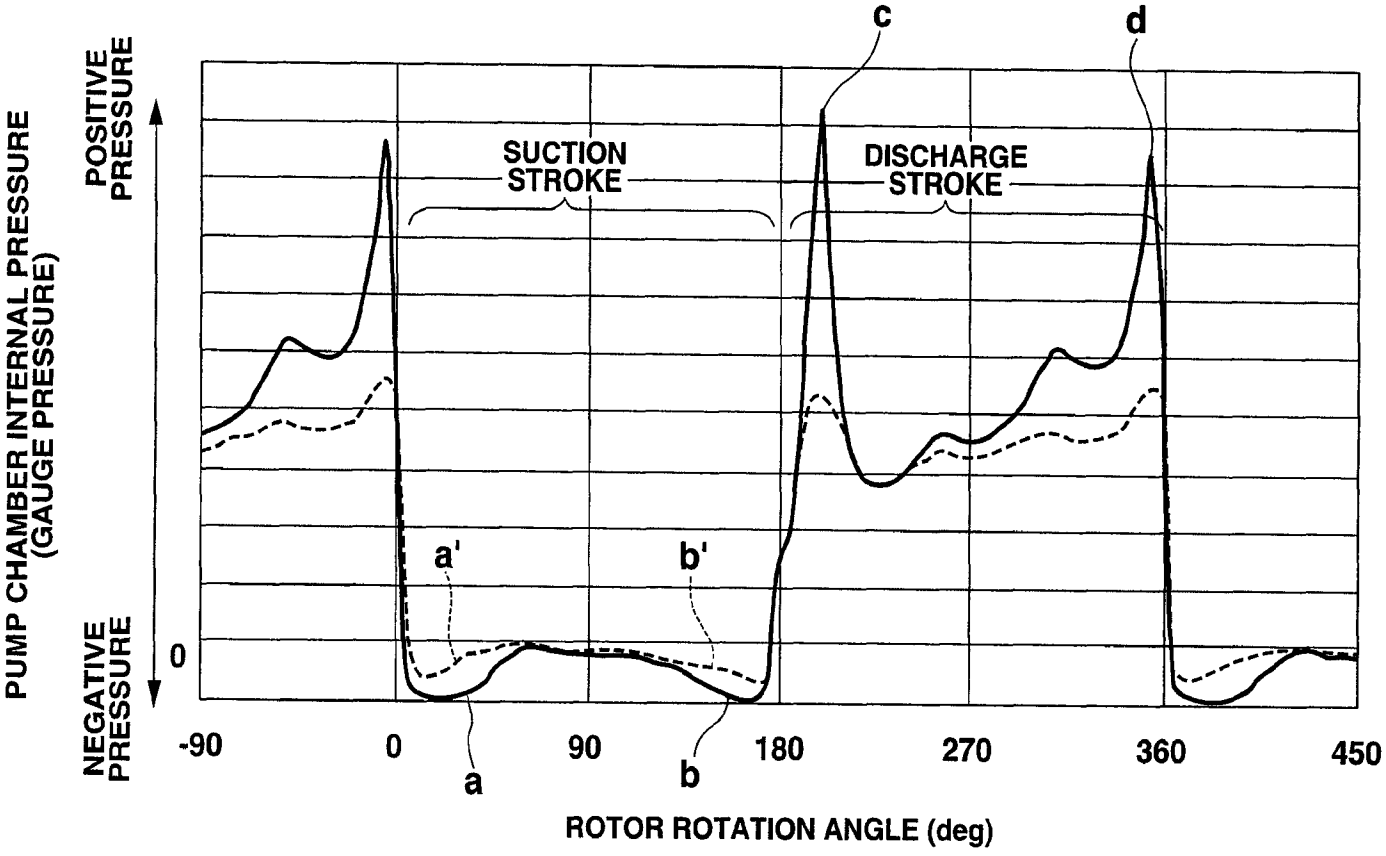
FIG. 17 is a characteristic showing a relationship between a rotor rotation angle and a pump chamber internal pressure of the present vane pump and the related art vane pump.

FIG. 17 is a characteristic showing a relationship between a rotor rotation angle and a pump chamber internal pressure. A pressure sensor is provided between the two slits 4*a* formed on the outer circumference surface of the rotor 4, and change of the internal pressure of each pump chamber 13 during the rotation of the rotor 4 is measured by this pressure sensor. In the drawing, a vertical axis is the internal pressure of the pump chamber 13 (gauge pressure), and a horizontal axis is the rotation angle (deg) of the rotor 4. When the rotation angle of the rotor 4 is 0° (=360°), a volume of the pump chamber 13 becomes a minimum. When the rotation angle of the rotor 4 is 180°, the volume of the pump chamber 13 becomes a maximum. A range of 0°~180° is a suction stroke (the suction section), while a range of 180°~360° is a discharge stroke (the discharge section).

In FIG. 17, a solid line shows an internal pressure change of a case where no communication grooves 24, 25 are provided. A broken line shows an internal pressure change of the present embodiment, i.e. the internal pressure change of the case where the inlet and outlet side communication grooves 24 and 25 are provided.

Regarding the vane pump having no communication grooves, as can be seen by the solid line, at the beginning of the suction stroke around rotation angle 0°, since shapes of both openings of the pump chamber 13 which face the inlet ports 7, 7' are thin long crescent shape, an opening area of each opening is insufficient for change of volume expansion or volume increase of the pump chamber 13 at high speed of the pump rotation. That is, the oil flowing into the pump chamber 13 through the inlet side cut grooves 18*a*, 18*b* can not sufficiently be drawn, and an suction negative pressure in the pump chamber 13 becomes large (shown by a in FIG. 17). Around rotation angle 90° of the rotor 4, since the opening area of the opening expands or increases, the oil can be sufficiently drawn, and the suction negative pressure becomes small once.

Around the end of the suction stroke just before the rotation angle 180°, the openings start to be closed in a state in which the volume of the pump chamber 13 increases and no inlet ports 7, 7' exist. Thus, the oil can not sufficiently be drawn, and the suction negative pressure becomes large again (shown by b in FIG. 17). Because the insufficient oil suction can not be resolved, the so-called cavitation occurs, and this causes insufficient oil discharge quantity or an occurrence of pump noise/vibration.

Figure 18:
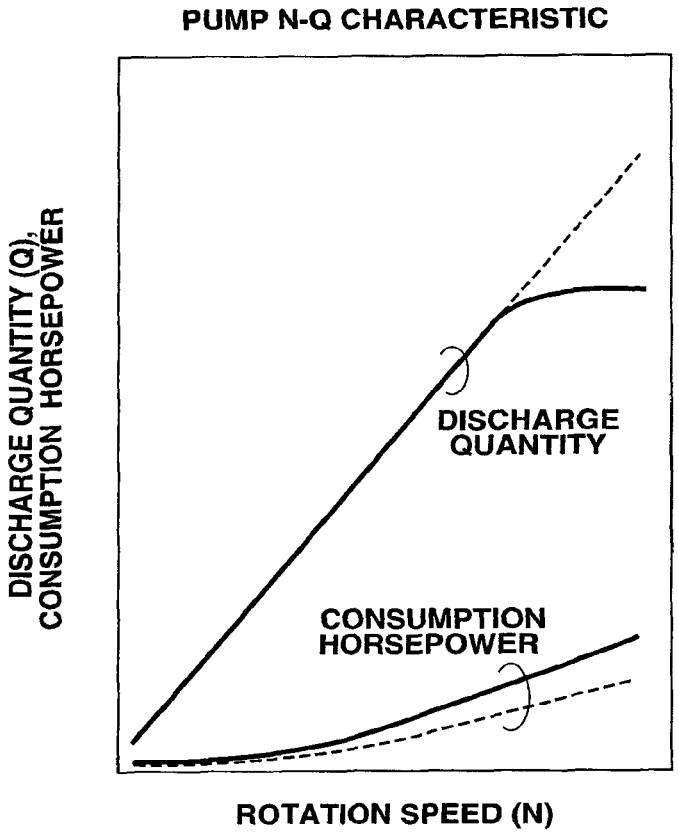
FIG. 18 is a characteristic showing a relationship between a pump rotation speed and a discharge quantity of the present vane pump and the related art vane pump.

FIG. 18 shows a relationship between a pump rotation speed (N) and a discharge quantity (Q) of the vane pump. As shown by a solid line (the related art vane pump), the discharge quantity does not increase in a high speed range of the pump. This is caused by the occurrence of the cavitation.

Returning to FIG. 17, when the rotation angle of the rotor 4 exceeds 180°, both sides of the pump chamber 13 in which the negative pressure has been increased open to the outlet port 8, 8' (the inner-side port section 8*b*). Since both sides of the pump chamber 13 open to the outlet port 8, 8' where the pressure is high, the oil flows into the outlet port 8, 8' rapidly at once. The oil then crashes into each other at almost circumferential middle portion of the inner circumference surface 5*a*, and a spike pressure (shown by c in FIG. 17) occurs.

Between the rotation angle 270°~360°, since shapes of the openings of both sides of the pump chamber 13 which face the outlet port 8, 8' are thin long crescent shape and become thinner, the internal pressure of the pump chamber 13 increases to discharge the oil to the outlet port 8, 8'.

Around the end of the discharge stroke around rotation angle 360°, since no outlet port 8, 8' exist and the openings of the pump chamber 13 are closed, a great closure pressure (shown by d in FIG. 17) occurs.

Increase of the internal pressure of the pump chamber 13 accompanied by the spike pressure (c) and the closure pressure (d) causes increase of friction of each part in pump and the occurrence of pump noise/vibration.

In particular, increase of the closure pressure (d) results in problem that lowers the actuation or operation pressure (moving pressure) of the cam ring 5. That is, although the actuation pressure of the cam ring 5 is essentially determined by the spring forces of the first and second coil springs 20, 22 and the pump discharge pressure in the control oil chamber 16 which acts on the outer circumference surface of the cam ring 5, the closure pressure (d) acts as a moving (rocking) torque in a direction in which the eccentric amount of the cam ring 5 becomes small from the inner circumference surface 5*a* of the cam ring 5, then lowers the actuation pressure of the cam ring 5.

Figure 19:
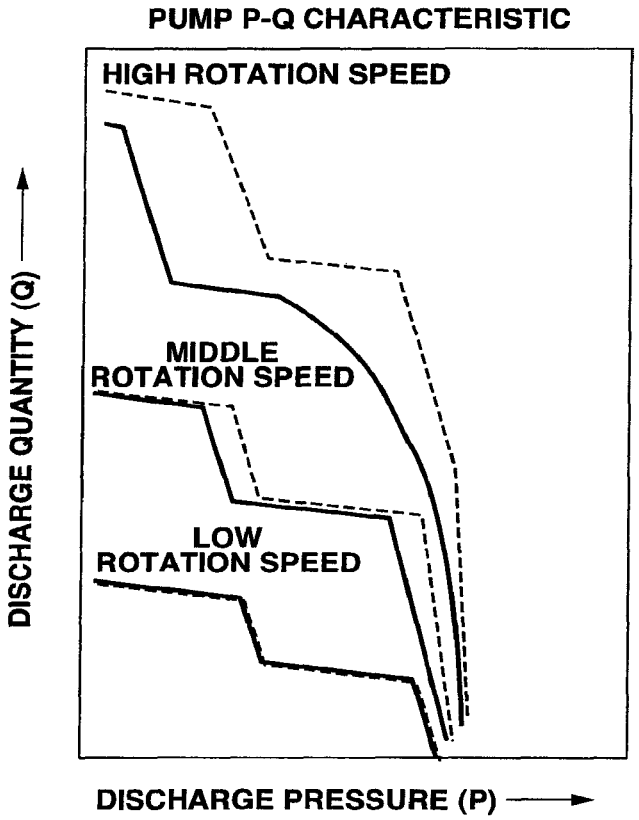
FIG. 19 is a characteristic of a pump discharge pressure and a discharge quantity of the present vane pump and the related art vane pump.

FIG. 19 shows a characteristic of a pump discharge pressure (P) and a discharge quantity (Q) according to the pump rotation speed. As is clear from this characteristic, in the case of the related art pump (a solid line), the pump discharge pressure sharply decreases with the increase in the pump rotation speed. This is caused by the lowering of the actuation pressure of the cam ring 5.

Figure 20:
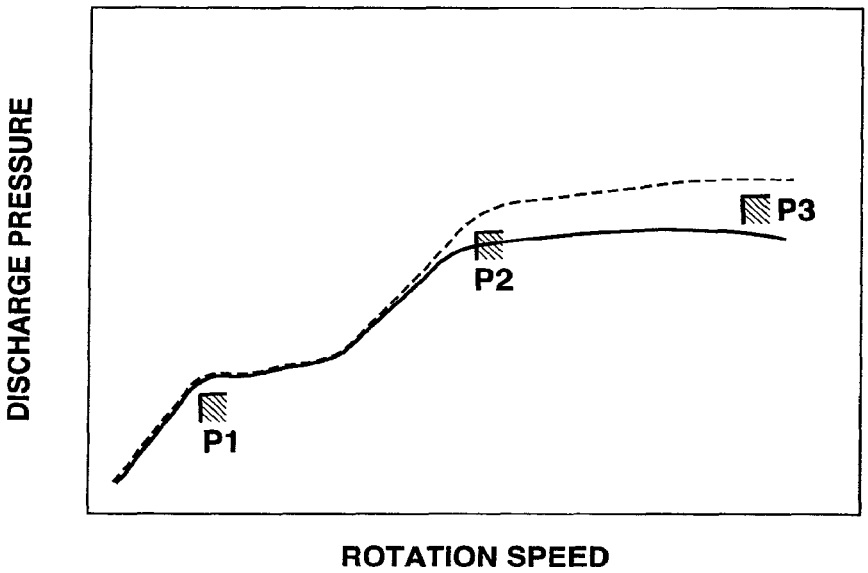
FIG. 20 is a characteristic showing a relationship between a pump rotation speed and a discharge pressure of the present vane pump and the related art vane pump.

FIG. 20 shows a relationship between a pump rotation speed and a pump discharge pressure. In the case of the related art pump (a solid line), although the pump discharge pressure increases with increase in the pump rotation speed, the pump discharge pressure does not increase any more from about a pump discharge pressure P2. This is also caused by the lowering of the actuation pressure of the cam ring 5.

Since the cause of the insufficient oil suction in the suction stroke is the insufficient opening area of the openings, facing the inlet ports 7, 7', of the pump chamber 13, the oil is the most insufficient at the middle in the axial direction in the pump chamber 13, i.e. at almost circumferential middle portion of the inner circumference surface 5*a*, and the suction negative pressure becomes large. Although decrease of the negative pressure becomes large in the pump chamber 13 at the suction start point (around the rotor rotation angle 0°) and at the suction end point (around the rotor rotation angle 180°), the decrease of the negative pressure is cancelled around the rotor rotation angle 90°.

In the present embodiment, the adjacent pump chambers 13, each of which opens to the inlet ports 7, 7', communicate with each other at almost circumferential middle portion of the inner circumference surface 5*a* through the inlet side communication groove 24. Hence, oil for canceling or resolving the insufficient oil suction can be supplied through this inlet side communication groove 24. As a consequence, the suction negative pressure can be shared or equalized, and the insufficient oil suction can be resolved.

This is shown by a broken line in FIG. 17. Around the rotor rotation angle 0° and the rotor rotation angle 180° in the suction stroke, internal pressures a' and b' (the broken line) of the pump chamber 13 are negative pressures and are close to 0, as compared with the suction negative pressure a and b (the solid line). Further, between the rotation angle 0°~180°, the internal pressure are equalized, as compared with that of the related art pump. This results from the setting of the inlet side communication groove 24.

In particular, since the inlet side communication groove 24 is set at the circumferential middle portion, in the axial direction of the cam ring 5, on the inner circumference surface 5*a*, it is possible to effectively suppress the occurrence of the cavitation at the middle portion where the negative pressure is apt to occur.

Further, as shown by broken lines in FIG. 18, the pump discharge quantity (Q) shows a proportional increase to the pump rotation speed (N) even in the high speed range of the pump without decreasing. Also consumption horsepower reduces. These result from the effect of suppressing the cavitation by the inlet side communication groove 24.

On the other hand, with respect to the discharge stroke, in the case of the related art having no outlet side communication groove 25, it is clear, as shown by the solid line, that the cause of increase of the internal pressure of the pump chamber 13 is the insufficient opening area of the openings, facing the outlet port 8, 8', of the pump chamber 13, and the internal pressure most increases at the middle portion, in the axial direction, in the pump chamber 13.

In contrast, in the present embodiment, since the outlet side communication groove 25 is provided and then the adjacent pump chambers 13 communicate with each other, as shown by the broken line, it is possible to equalize the internal pressure of the pump chamber 13. With this, as shown by broken lines in FIG. 19, an effect of improving the lowering of the actuation pressure of the cam ring 5 can be obtained.

In addition, as shown by the broken lines in FIG. 18, it is clear that consumption horsepower in the high speed range reduces. This results from the effect of equalizing the internal pressure of the pump chamber 13 by the outlet side communication groove 25.

Moreover, as shown by a broken line in FIG. 20, also an effect of suppressing decrease of the pump discharge pressure in the pump high speed range results from the working of the outlet side communication groove 25 together with the working of the inlet side communication groove 24.

Next, in the embodiment, the starting-point portions 24*a*, 25*a* and the endpoint portions 24*b*, 25*b* of the inlet and outlet side communication grooves 24 and 25 are set so that these portions 24*a*, 25*a* and 24*b*, 25*b* have the arc-shaped surface and their depths are gradually shallower from the middle of the inlet and outlet side communication grooves 24 and 25. Operation and Effect by these structures will be explained.

Figure 9:
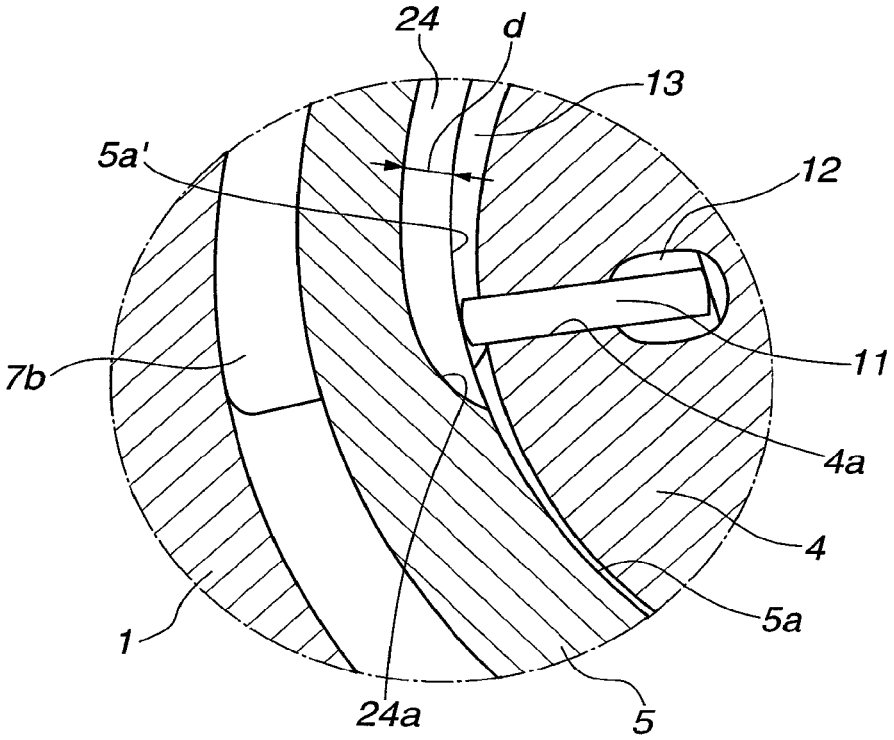
FIG. 9 is an enlarged view of a circle B in FIG. 8.

As shown in FIG. 9, when the pump chamber 13 changes from the discharge section (the discharge stroke) to the suction section (the suction stroke) through a minimum volume section, since the depth of the groove of the starting-point portion 24*a* of the inlet side communication groove 24 is gradually deeper and a cross-sectional area of the inlet side communication groove 24 is gradually larger, a rapid release of the closure pressure (shown by d in FIG. 17) can be suppressed. This can adequately suppress a rapid change of the pressure and an occurrence of the noise/vibration caused by this rapid pressure change.

Figure 10:
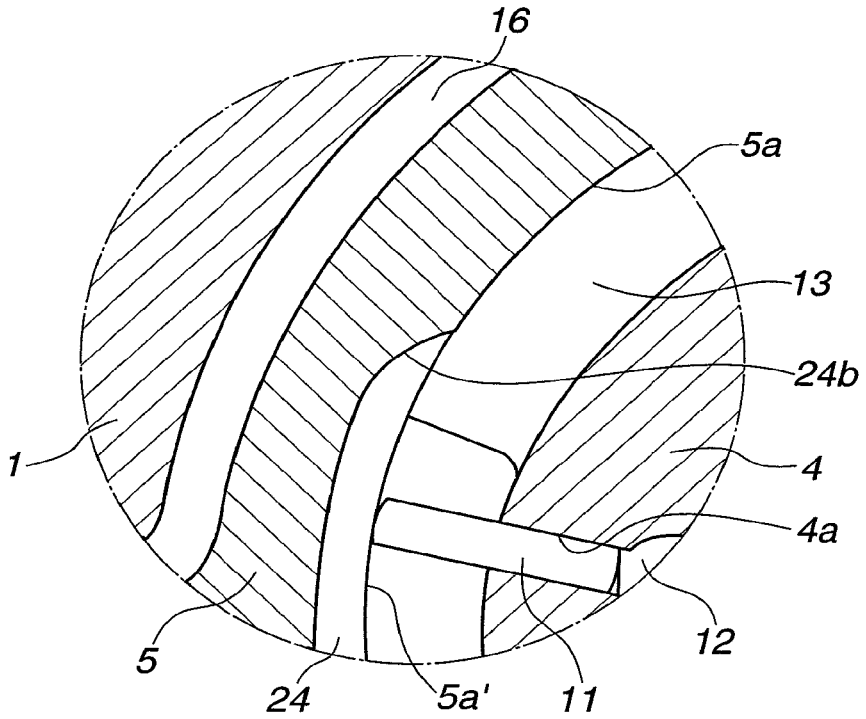
FIG. 10 is an enlarged view of a circle C in FIG. 8.

As for the endpoint portion 24*b* side of the inlet side communication groove 24, as shown in FIG. 10, since the depth of the groove of the endpoint portion 24*b* is gradually shallower from the middle of the inlet side communication groove 24, the oil dragged in the inlet side communication groove 24 by the rotation of the vane 11 flows into the pump chamber 13 that is positioned at a rotation direction side by an inclined surface (the arc-shaped surface) of the endpoint portion 24*b*. That is, a pressure-charging (or supercharging) effect of the oil can be obtained. As a consequence, the effect of reducing or suppressing the cavitation can be further obtained.

Figure 11:
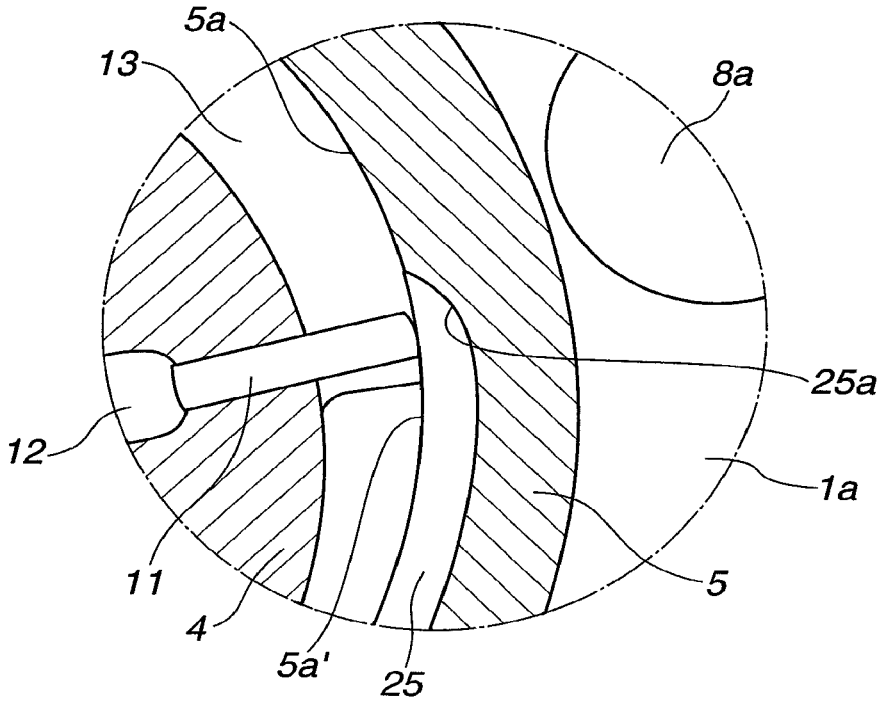
FIG. 11 is an enlarged view of a sectional view of the cam ring at a discharge side.
Figure 12:
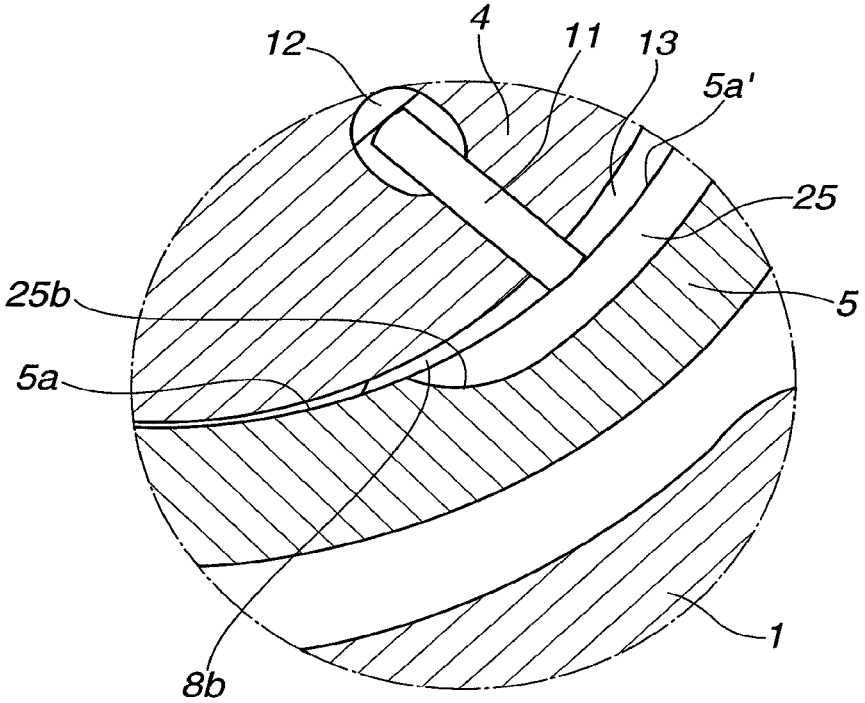
FIG. 12 is an enlarged view of a sectional view of the cam ring at a discharge side.

On the other hand, with regard to the starting-point portion 25*a* side of the outlet side communication groove 25, as shown in FIG. 11, when the pump chamber 13, which is in the negative pressure state, changes from the suction stroke to the discharge stroke, since the depth of the groove of the starting-point portion 25*a* is gradually deeper with the rotation of the rotor 4 (the vane 11), the high pressure from the adjacent pump chambers 13 positioned at the outlet port 8, 8' side in an opposite direction to the rotation direction is not rapidly released. With this, the occurrence of the great spike pressure (shown by c in FIG. 17) is suppressed, thereby reducing the noise/vibration.

Further, the inlet and outlet side communication grooves 24 and 25 are formed at the circumferential middle portion, in the axial direction, of the inner circumference surface 5*a*, and the both circumferential edge side portions (circumferential edge side surfaces) 5*a*', 5*a*' exist on both sides of each of the communication grooves 24, 25. With this structure, the vanes 11 rotate by the rotation of the rotor 4 with each top end edge of the vane 11 guided and supported by and making sliding contact with the both circumferential edge side portions 5*a*', 5*a*'. Accordingly, each vane 11 is supported with stability even at the communication grooves 24, 25 sides without inclining or leaning, and a problem that the vanes 11 strike against the bottom surface 1*a* of the pump housing 1 at edge portions of the inlet ports 7, 7' and the outlet port 8, 8' then are broken can be prevented.

Furthermore, the inlet side cut grooves 18*a*, 18*b* are formed on the axial direction both end surfaces of the cam ring 5. Therefore, good oil flow (inflow) from the inlet ports 7, 7' into the pump chamber 13 can be ensured. Likewise, the outlet side cut grooves 18*c*, 18*d* are also formed on the axial direction both end surfaces of the cam ring 5. Good oil flow (outflow) from each pump chamber 13 to the outlet port 8, 8' can be therefore ensured.

In the present embodiment, although the inlet and outlet side communication grooves 24 and 25 are formed at the substantially middle portion of the axial direction width on the inner circumference surface 5*a*, their positions could shift. That is, since there is a case where an area where the negative pressure is greatest and an area where the increase in the internal pressure is highest in the pump chamber 13 shift from the middle portion of the axial direction width to both sides depending on the depths of the inlet ports 7, 7' and the outlet port 8, 8' provided on the pump housing 1 side and the cover 2 side, in this case, the positions where the communication grooves 24, 25 are formed could shift to one side of the circumferential edge side portions 5*a*', 5*a*' on the inner circumference surface 5*a*. However, also in this case, the communication grooves 24, 25 are formed in the position so as to always include the middle of the axial direction width on the inner circumference surface 5*a*.

Figure 21:
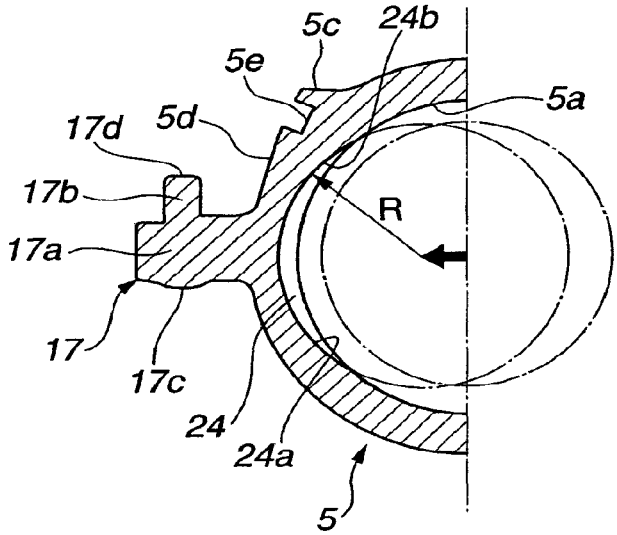
FIG. 21 is a sectional view of a cam ring of another embodiment, showing a main part of a communication groove of the cam ring.
Figure 22:
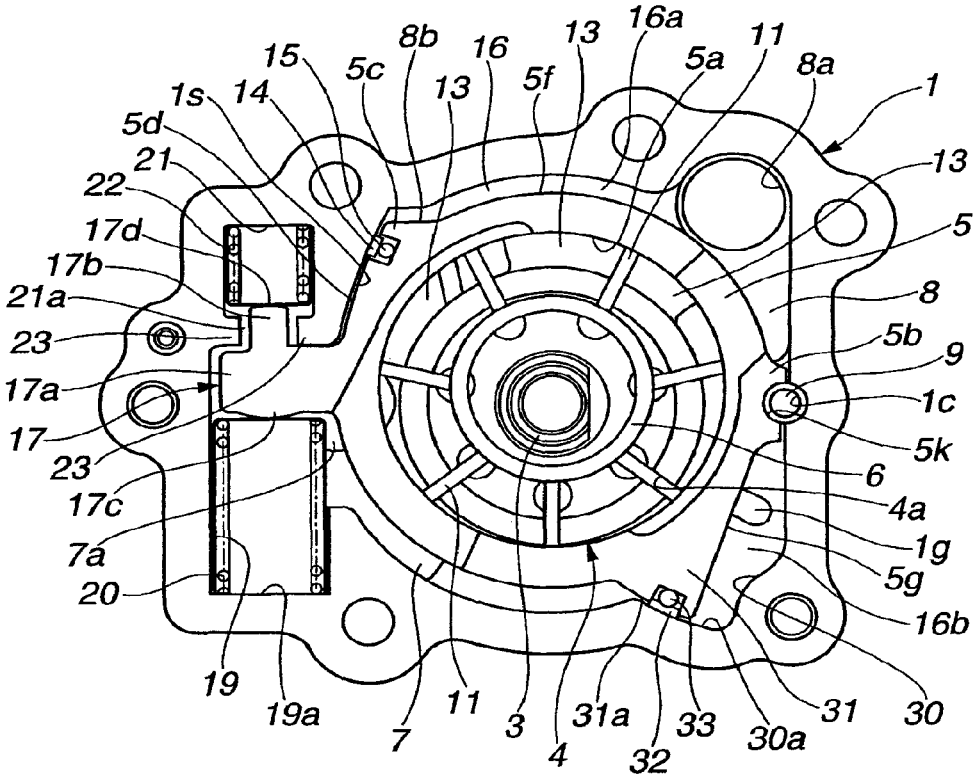
FIG. 22 is a front view of a vane pump of a second embodiment with a pump cover removed.

Further, as shown in FIG. 21, the communication grooves 24, 25 and the starting-point portions 24*a*, 25*a* and the endpoint portions 24*b*, 25*b* could be formed so that the communication grooves 24, 25 are formed into an arc shape having a large radius R of curvature by cutting and depths of the rounded surfaces of the starting-point portions 24*a*, 25*a* and the endpoint portions 24*b*, 25*b* gradually change from the middle portion, or more specifically constantly change from a mid-point.

Second Embodiment

FIG. 2 shows a second embodiment. A basic structure such as the main components is the same as the first embodiment. However, in this embodiment, two control oil chambers 16*a* and 16*b*, which move the cam ring 5 by hydraulic pressure (pressurized fluid or oil) so that the eccentric amount of the cam ring 5 becomes large, are formed at upper and lower sides of the pivot pin 9 with the pivot pin 9 being a center.

That is, the control oil chamber 16 of the first embodiment corresponds to the first control oil chamber 16*a* of the second embodiment. The second control oil chamber 16*b* is formed by a substantially L-shaped concave trench 30 at the lower side of the pivot pin 9 inside the pump housing 1.

A second seal surface 30*a* is provided at a lower portion of the concave trench 30. More specifically, the second seal surface 30*a* is formed into an arc-shaped surface having a certain radius with the pivot pin 9 being a center.

On the other hand, a substantially triangular convex portion 31 which faces the concave trench 30 is formed integrally with the cam ring 5. The convex portion 31 has, in an opposing position to the second seal surface 30*a*, an arc-shaped surface 31*a* having the certain radius with the pivot pin 9 being the center. Further, a holding groove having a rectangular shape in longitudinal cross section is formed on a top end side of the arc-shaped surface 31*a*. A sealing member 32 making sliding contact with the second seal surface 30*a* and an elastic member 33 having a rectangular shape in longitudinal cross section for pressing the sealing member 32 against the second seal surface 30*a* are provided in the holding groove.

An arc length of the second seal surface 30*a* is set so that the sealing member 32 can make sliding contact with the second seal surface 30*a* even when the cam ring 5 moves and its eccentric amount with respect to the rotor 4 varies from the maximum eccentric position (FIG. 2) to the minimum eccentric position (FIG. 14).

The second control oil chamber 16*b* communicates with the outlet port 8 via a communication groove 1*g* that is formed on the bottom surface 1*a* of the pump housing 1. Therefore, the same discharge pressure as the discharge pressure which the pressure-receiving surface 5*f* receives in the first control oil chamber 16*a* acts on a second pressure-receiving surface 5*g* formed on an outer circumference surface of the cam ring 5, which faces the second control oil chamber 16*b*.

The radius of curvature of the second arc-shaped surface 31*a* is set to be smaller than the radius of curvature of the first arc surface 5*d* on the first sealing member 14 side. Thus, a surface area of the second pressure-receiving surface 5*g* is smaller than that of the first pressure-receiving surface 5*f*. When the discharge pressures in the first and second control oil chambers 16*a*, 16*b* act on the pressure-receiving surfaces 5*f*, 5*g* respectively, the moving (rocking) torque in the counterclockwise direction is generated to the cam ring 5, same as the first embodiment. However, since the hydraulic pressure torque from the second control oil chamber 16*b*, which acts on only the second pressure-receiving surface 5*g*, is the torque in the clockwise direction, part of the torque from the first control oil chamber 16*a* is cancelled. As a result, in a case where the discharge pressures in the first and second control oil chambers 16*a*, 16*b* are the same, the moving torque of the cam ring 5 is small as compared with the first embodiment.

Thus, since the spring forces of the first and second coil springs 20, 22 can be set to be small, each coil diameter of the coil springs 20, 22 can be set to be small. This leads to reduction in overall size of the vane pump.

However, since the moving torque generated to the pressure-receiving surfaces 5*f*, 5*g* of the cam ring 5 becomes small, an effect of the increase of the internal pressure of each pump chamber 13 on the actuation pressure of the cam ring 5 becomes large. The effect of improving the lowering of the actuation pressure of the cam ring 5 by the inlet and outlet side communication grooves 24, 25 therefore works well.

The present invention is not limited to the above embodiments. For example, each axial direction width of the inlet and outlet side communication grooves 24, 25 could be set to be small. Or each of the inlet and outlet side communication grooves 24, 25 might be formed by a plurality of narrow long bands arranged parallel to each other.

Further, instead of the inlet and outlet side communication grooves 24, 25 of the communication portions, a hole or a conduit could be provided in the cam ring 5 as a communication channel.

Furthermore, although the sealing member 14 is provided to ensure the liquid-tightness of the control oil chamber 16; if a required pressure characteristic for the internal combustion engine is satisfied, the sealing member could be eliminated for cost reduction.

Arrangement of the first and second spring holders 19, 21 could be changed. The spring loads of the first and second coil springs 20, 22 can be freely set according to specifications of the pump or a pump size, also their coil diameters and lengths could be changed.

As for the variable valve timing control apparatus, a variable valve control apparatus is not limited to the variable valve timing control apparatus. For instance, it could be a valve-lift control apparatus driven by the fluid pressure and controlling an operating angle and a lift amount of the engine valve. Then the present invention can be used as the actuating source of the valve-lift control apparatus.

Moreover, the vane pump of the present invention can be used for fluid pressure-driven devices except the internal combustion engine.

From the foregoing, the present invention has the following effects. The groove 24; 25 is formed so that a depth of the groove 24; 25 is gradually shallower from a middle, in the circumferential direction, of the groove 24; 25 to both ends of the groove 24; 25.

Since the depth of the both ends, in the circumferential direction, of the groove 24; 25 is gradually shallower, the oil coming from the middle of the groove 24; 25 into one of the adjacent pump chambers 13 can smoothly flow into the other of the adjacent pump chambers 13.

The groove 24; 25 is formed by cutting. Since the groove 24; 25 is formed only by cutting, production cost can be reduced.

The grooves 24; 25 are provided in both of the oil suction section and the oil discharge section on the inner circumference surface 5*a* of the cam ring 5. With this, the occurrence of the cavitation in the suction section can be suppressed, and also the pressure change in the discharge section can be suppressed, then the stable movement of the cam ring 5 can be achieved.

The vane pump is a vane pump in which the oil is drawn from both sides, in the axial direction, of the cam ring 5 and is discharged from both sides, in the axial direction, of the cam ring 5, and the groove 24; 25 is formed at a circumferential portion except both circumferential edge sides 5*a*', 5*a*' of the axial direction width on the inner circumference surface 5*a* of the cam ring 5.

Widths of the both circumferential edge sides 5*a*', 5*a*' of the axial direction width on the inner circumference surface 5*a*, where no groove 24; 25 exists, are set to be substantially the same.

The communication portion 24 is formed by a groove 24 that extends in a circumferential direction of the inner circumference surface 5*a* of the cam ring 5.

The groove 24 is formed so that depths of both ends of the groove 24 is shallower than that of a middle, in the circumferential direction, of the groove 24.

The cam ring 5 moves with respect to the rotor 4 and an eccentric amount of the cam ring 5 with respect to the rotor 4 changes, and an oil amount discharged from the outlet port 8 is varied by the change of the eccentric amount.

The cam ring 5 is forced in a direction in which the eccentric amount with respect to the rotor 4 becomes large by a forcing member 20, and the cam ring 5 is moved in an opposite direction against the force of the forcing member 20, for controlling the oil discharge amount.

The cam ring 5 is configured to move in the opposite direction by receiving a pressure of the outlet port 8.

The communication portion 24 is formed by a communication conduit.

From the foregoing, the stable action of the cam ring can be achieved all the time.

The entire contents of Japanese Patent Application No. 2010-18201 filed on Jan. 29, 2010 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A vane pump in which oil is drawn from at least one side, in an axial direction, of a cam ring and is discharged from at least the one side, in the axial direction, of the cam ring, the vane pump comprising:

a portion defined by a groove formed on an inner circumference surface of the cam ring, the groove extending along a circumferential direction of the inner circumference surface and arranged in a position including a middle of an axial direction width on the inner circumference surface in an oil suction section or an oil discharge section of the cam ring, the groove being formed so that a depth of the groove is constantly shallower from a mid-point, in the circumferential direction, of the groove to both ends of the groove.

2. The vane pump as claimed in claim 1, wherein:

the groove is a cut groove.

3. The vane pump as claimed in claim 1, wherein:

the groove is provided in both of the oil suction section and the oil discharge section on the inner circumference surface of the cam ring.

4. The vane pump as claimed in claim 1, wherein:

the oil is drawn from both sides, in the axial direction, of the cam ring, and is discharged from both sides, in the axial direction, of the cam ring, and the groove is formed at a circumferential portion except both circumferential edge sides of the axial direction width on the inner circumference surface of the cam ring.

5. The vane pump as claimed in claim 4, wherein:

widths of the both circumferential edge sides of the axial direction width on the inner circumference surface, where no groove exists, are substantially the same.

6. A vane pump comprising:

a rotor configured to be rotatably driven;

a plurality of vanes arranged at an outer circumference of the rotor, and configured to be extending/retracting in a radial direction;

a cam ring, having at an inner circumferential side thereof, the rotor and the plurality of vanes, the extending/retracting movement of the plurality of vanes occurring by the rotation of the rotor and effecting sliding contact of each top end edge of the plurality of vanes with an inner circumference surface of the cam ring;

a housing containing the cam ring inside, and defining a plurality of pump chambers by a combination of the housing, the plurality of vanes, the cam ring and the rotor;

an inlet port provided at at least one side of both side walls of the housing which respectively face axial direction both sides of the cam ring and opening to a section where the plurality of vanes extend;

an outlet port provided at at least the one side of the both side walls of the housing which respectively face the axial direction both sides of the cam ring and opening to a section where the plurality of vanes retract; and a communication portion formed at a circumferential portion except both circumferential edge sides of an axial direction width on the inner circumference surface of the cam ring in the section where the plurality of vanes extend and connecting the plurality of pump chambers, the communication portion being formed so that a depth of the communication portion is constantly shallower from a mid-point, in the circumferential direction, of the communication portion to both ends of the communication portion.

7. The vane pump as claimed in claim 6, wherein:

the communication portion is formed by a groove that extends in a circumferential direction of the inner circumference surface of the cam ring.

8. The vane pump as claimed in claim 7, wherein:

the cam ring moves with respect to the rotor and an eccentric amount of the cam ring with respect to the rotor changes, and an oil amount discharged from the outlet port is varied by the change of the eccentric amount.

9. The vane pump as claimed in claim 8, wherein:

the cam ring is forced in a direction in which the eccentric amount with respect to the rotor becomes large by a forcing member, and the cam ring is moved in an opposite direction against the force of the forcing member, for controlling the oil discharge amount.

10. The vane pump as claimed in claim 9, wherein:

the cam ring is configured to move in the opposite direction by receiving a pressure of the outlet port.

11. A vane pump comprising:

a rotor configured to be rotatably driven and having, at an outer circumference thereof, a plurality of opening slots;

a plurality of vanes provided in the respective slots;

a cam ring, having at an inner circumferential side thereof, the rotor and the plurality of vanes configured for extending/retracting movement of the plurality of vanes at the outer circumference of the rotor occurring by the rotation of the rotor;

a housing containing the cam ring inside, and defining a plurality of pump chambers by a combination of the housing, the plurality of vanes, the cam ring and the rotor;

an inlet port provided at at least one side of both side walls of the housing which respectively face axial direction both sides of the cam ring and opening to a section where a volume of the pump chamber increases;

an outlet port provided at at least the one side of the both side walls of the housing which respectively face the axial direction both sides of the cam ring and opening to a section where the volume of the pump chamber decreases; and a communication portion formed at a circumferential portion except both circumferential edge sides of an axial direction width on an inner circumference surface of the cam ring in the section where the volume of the pump chamber decreases and connecting the plurality of pump chambers, the communication portion being formed so that a depth of the communication portion is constantly shallower from a mid-point, in the circumferential direction, of the communication portion to both ends of the communication portion.

12. The vane pump as claimed in claim 11, wherein:

the cam ring moves with respect to the rotor and an eccentric amount of the cam ring with respect to the rotor changes, and an oil amount discharged from the outlet port is varied by the change of the eccentric amount.

* * * * *